US008147261B2

(12) United States Patent
Horiuchi

(10) Patent No.: US 8,147,261 B2
(45) Date of Patent: Apr. 3, 2012

(54) CONNECTOR

(75) Inventor: Hidefumi Horiuchi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 146 days.

(21) Appl. No.: 12/638,396

(22) Filed: Dec. 15, 2009

(65) Prior Publication Data

US 2010/0159734 A1 Jun. 24, 2010

(30) Foreign Application Priority Data

Dec. 22, 2008 (JP) ..... 2008-325122
Dec. 22, 2008 (JP) ..... 2008-325133

(51) Int. Cl.
*H01R 13/62* (2006.01)

(52) U.S. Cl. ..... 439/157; 439/372

(58) Field of Classification Search ..... 439/157, 439/372

See application file for complete search history.

(56) References Cited

U.S. PATENT DOCUMENTS

| | | | | |
|---|---|---|---|---|
| 6,409,525 | B1 * | 6/2002 | Hoelscher et al. | 439/140 |
| 7,210,948 | B2 | 5/2007 | Nishide | |
| 2003/0119349 | A1 * | 6/2003 | Bakker et al. | 439/140 |
| 2008/0081498 | A1 * | 4/2008 | Fukatsu et al. | 439/157 |
| 2008/0102668 | A1 * | 5/2008 | Ikeya et al. | 439/157 |
| 2008/0132098 | A1 * | 6/2008 | Tyler et al. | 439/157 |

FOREIGN PATENT DOCUMENTS

| | | |
|---|---|---|
| JP | 11-067338 | 3/1999 |

* cited by examiner

*Primary Examiner* — Hien Vu
(74) *Attorney, Agent, or Firm* — Gerald E. Hespos; Michael J. Porco

(57) ABSTRACT

A connector assembly has a male connector (10) with a receptacle (14), a female connector (60) to be fit into the receptacle (14) and a moving plate (40) for positioning male terminal fittings (20). The moving plate (40) includes a plate-like plate main body (42) with positioning holes 47 and is movable toward a back side of the receptacle (14) together with the female connector (60) from an initial position where leading ends of the male terminal fittings (20) project through the positioning holes (47). Protection walls (41) project forward to protect the leading ends of the male terminal fittings (20) projecting at the initial position. The female connector (60) is formed with recesses (66) for permitting the protection walls (41) to escape. Each protection wall (41) is arranged between adjacent male terminal fitting groups (20).

8 Claims, 24 Drawing Sheets

CONNECTOR

BACKGROUND OF THE INVENTION

1. Field of the Invention

The invention relates to a connector.

2. Description of the Related Art

U.S. Pat. No. 7,210,948 discloses a connector assembly with male and female connectors. The male connector has a forwardly open tubular receptacle and male terminal fittings that project into the receptacle. The female connector is configured to fit into the receptacle from the front. A moving plate is accommodated in the receptacle and can move in forward and backward directions. The moving plate has a plate-like plate main body with positioning holes, and leading end portions of male terminal fittings project through the positioning holes at an initial position of the moving plate before the connection with a female housing. Thus, an electrical connection test can be conducted by bringing a probe pin into contact with the leading end portions of the male terminal fittings projecting from the front when the plate main body is at the initial position. However, a corner of the female housing may possibly collide with and deform the leading ends of the male terminal fittings when the female housing is inserted into the receptacle while inclined with respect to forward and backward directions.

FIG. 24 shows a known resin molded moving plate with a peripheral wall 1 that is accommodated in a receptacle 2. The peripheral wall 2 may be indented during molding, and hence the moving plate may have an improper posture in the receptacle 2. A clearance 3 is formed between the outer surface of the peripheral wall 1 and the inner surface of the receptacle 2 if the moving plate has an improper posture.

The present invention was developed in view of the above situation and an object thereof is to improve operability of the connector.

SUMMARY OF THE INVENTION

The invention relates to a connector assembly with male and female housings. The male housing has a forwardly open tubular receptacle that is configured to receive the female housing from the front. Male terminal fittings are accommodated in the male housing and project into the receptacle. A moving plate is accommodated in the receptacle and has a plate-like plate main body with positioning holes for positioning the male terminal fittings. The moving plate can be held at an initial position where leading end portions of the male terminal fittings project through the positioning holes and from the front surface of the plate main body. The moving plate can move with the female housing from the initial position toward a back side of the receptacle. At least one protection wall projects forward from the plate main body and protects the leading end portions of the male terminal fittings when the moving plate is at the initial position. The female housing has at least one recess for permitting the protection wall to escape.

The female housing may be inserted into the front of the receptacle in an improper posture while the moving plate is at the initial position in the receptacle. However, a corner of the female housing will collide with the projecting end of the protection wall to prevent deformation of the male terminal fittings. Improper posture in this context means a vertically inclined posture and/or a horizontally inclined posture when vertical and/or horizontal directions are orthogonal to each other in directions intersecting a connecting direction. The deformation of the male terminal fittings is prevented regardless of any inclination of the female housing in either of the vertical and horizontal directions. Thus, operational efficiency is improved by preventing the deformation of the male terminal fittings in a connector that has a moving plate.

The male housing preferably is formed with the tubular receptacle by assembling a plurality of auxiliary housings into a frame.

The protection wall preferably is arranged between first and second adjacent male terminal fitting groups in one auxiliary housing.

The protection wall may be thinned toward the front to facilitate insertion.

At least one peripheral wall may project forward from the periphery of the plate main body. At least one lateral end of the protection wall may be connected with the peripheral wall to prevent inclination of the protection wall and to increase rigidity of the moving plate. The front of the protection wall may have at least one cutout to prevent a locking from interfering with the protection wall.

At least one laterally projecting reinforcing wall may be connected with the protection wall to prevent inclination of the protection wall and to increase an area that can interfere with the female housing when the female housing is in an improper posture. Thus, the female housing is more likely to interfere with the protection wall or the reinforcing wall to prevent deformation of the male terminal fittings. At least one hole may be formed at a position of the plate main body corresponding to the reinforcing wall for receiving a jig. The reinforcing wall and prevents the jig from contacting the male terminal fittings.

The peripheral wall of the moving plate may have plate-like walls that project from the periphery of the plate main body to define a tube that moves along the inner peripheral surface of the receptacle. A lock may be formed on the outer surface of the wall at a position corresponding to an intermediate part of an opening edge. An engageable portion is provided at a position of the receptacle facing the outer surface of the wall for engaging the lock and correcting the peripheral wall to a proper posture. The peripheral wall of the moving plate could be deformed during molding and could deviate from a proper posture. However, the lock engages the engageable portion to correct the posture of the peripheral wall. Thus, a connection surface of the female housing will not interfere with the opening edge of a deformed peripheral wall upon connecting the housings.

The lock may have projections that face the outer surface of the wall, and two projections may project in opposite directions along the outer surface of the wall. Accordingly, the lock and the engageable portion can be engaged to locate the engageable portion between the two projections and the outer surface of the wall. The two projections may be arranged to be asymmetric with respect to an axis passing between the two projections to prevent erroneous mounting of the moving plate into the receptacle.

Two introducing grooves may be formed in the outer surfaces of the walls and open in intermediate parts of opening edges. The two projections may project from two side walls forming each introducing groove. Accordingly, the projections can be formed utilizing the two side walls of each introducing groove.

These and other objects, features and advantages of the invention will become more apparent upon reading the following description of preferred embodiments and accompanying drawings.

DETAILED DESCRIPTION OF THE PREFERRED EMBODIMENTS

Figure 1:
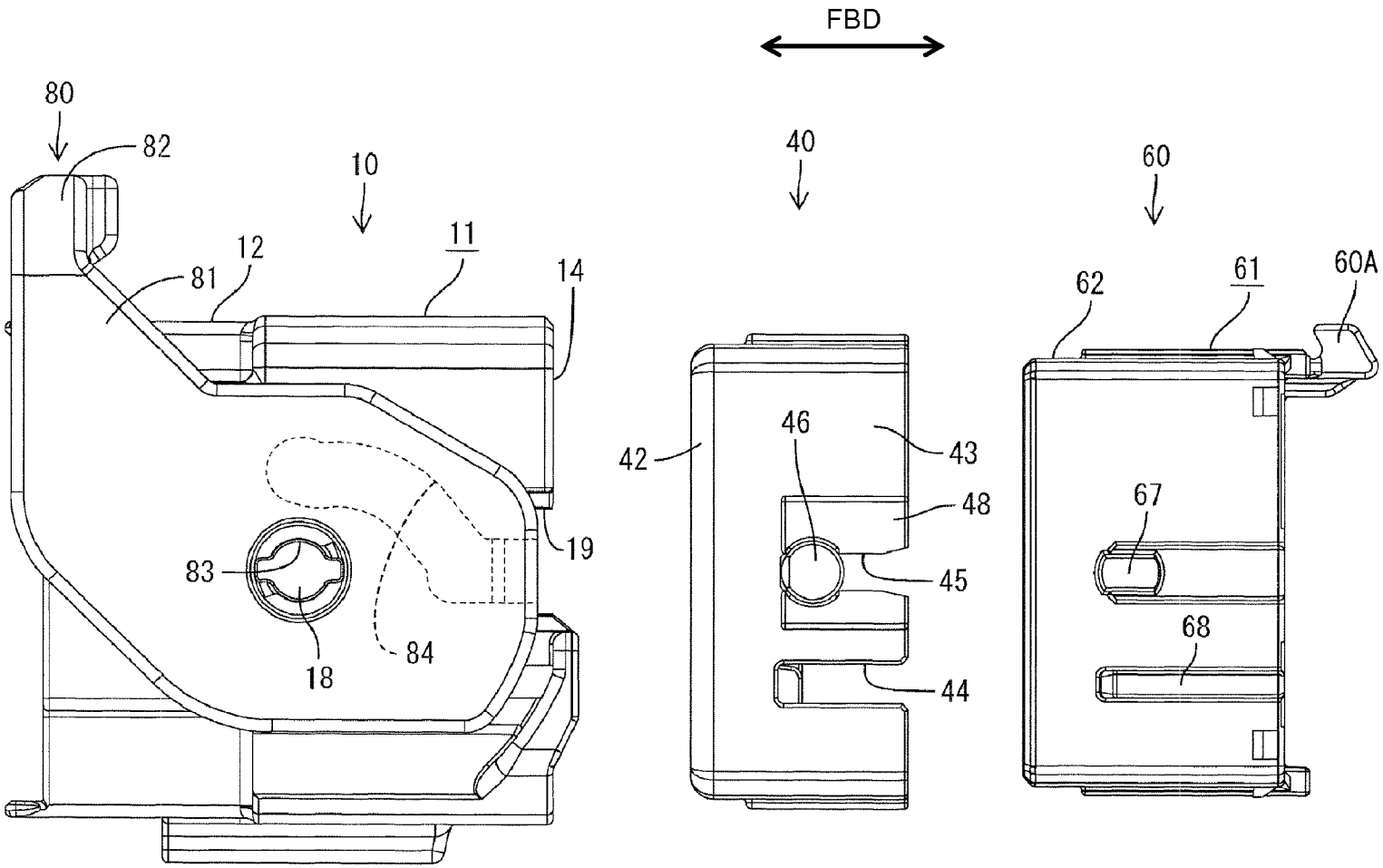
FIG. 1 is a side view showing a state before a moving plate is mounted into a male connector and two connectors are connected.

A connector assembly in accordance with the invention is described with reference to FIGS. 1 to 23. The connector assembly includes a male connector 10 and 60 and a female connector 60 to be connected with the male connector 10, as shown in FIG. 1. In the following description, ends of the two connectors 10, 60 to be connected are referred to as front ends concerning forward and backward directions FBD.

Figure 9:
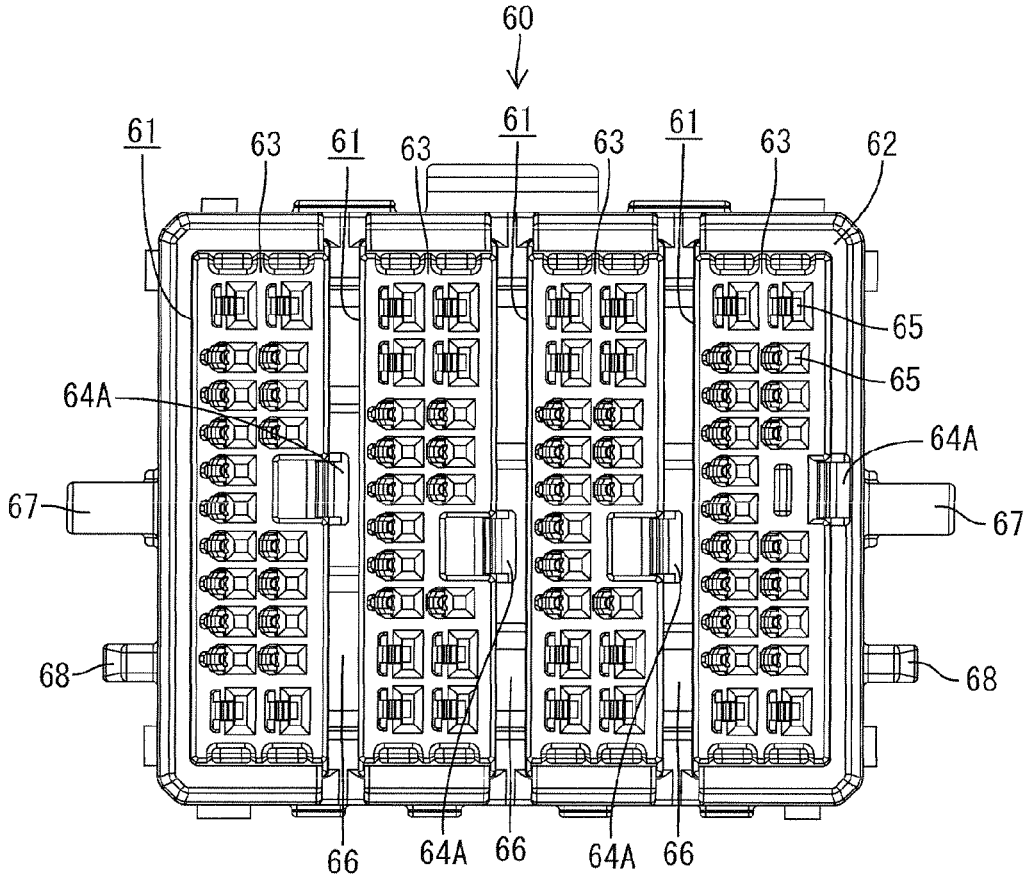
FIG. 9 is a front view of the female connector.

As shown in FIG. 9, the female connector 60 has a plurality of female auxiliary connectors 61 assembled into a female frame 62 made e.g. of synthetic resin. Each female auxiliary connector 61 has a female auxiliary housing 63 made e.g. of synthetic resin. The female housing mentioned herein is comprised of the female frame 62 and the female auxiliary housings 63 and is in the form of a substantially rectangular block.

Figure 6:
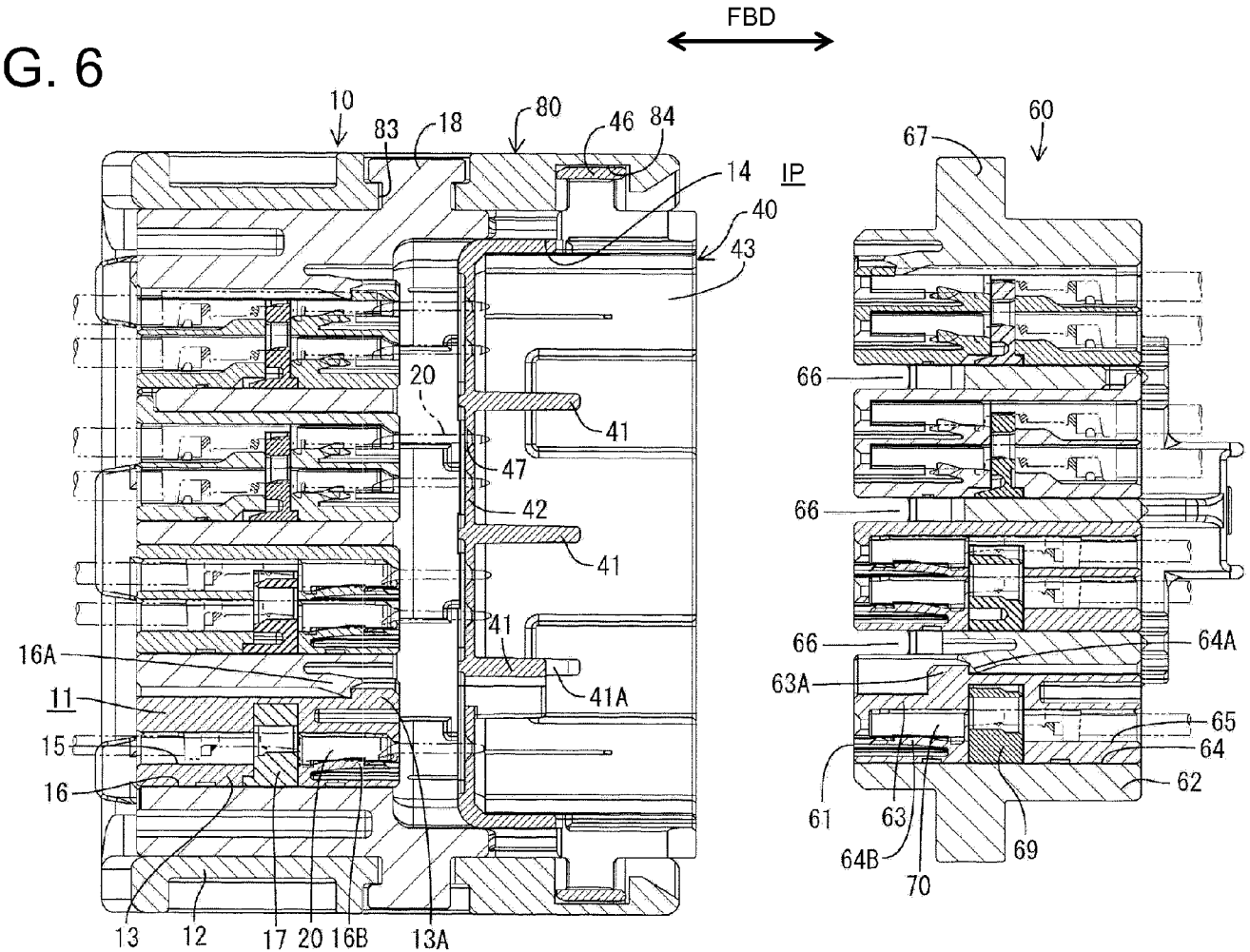
FIG. 6 is a side view in section of a state before the moving plate is mounted at the initial position in the male connector and the two connectors are connected.

As shown at the right side of FIG. 6, female auxiliary connector accommodating portions 64 penetrate the female frame 62 in forward and backward directions FBD and are configured for accommodating the respective female auxiliary connectors 61. An interlocking portion 63A is provided on the outer surface of each female auxiliary housing 63. On the other hand, a lock 64A is provided in each female auxiliary connector accommodating portion 64. The lock 64A engages the interlocking portion 63A when the female auxiliary connector 61 is inserted from behind to a proper position in the female auxiliary connector accommodating portion 64, as shown in FIG. 6, to prevent the female auxiliary connector 61 from coming out backward.

Cavities 65 penetrate the female auxiliary housings 63 in forward and backward directions FBD and are configured to accommodate female terminal fittings 70. The cavities 65 are arranged in the female auxiliary connector 61 in a height or vertical direction in FIG. 9. Locking lances 64B and a retainer 69 hold the female terminal fittings 70 in the cavities 65 so as not to come out backward, as shown in FIG. 6.

Recesses 66 are formed in a front connection surface of the female frame 62 between the respective female auxiliary connectors 61, as shown in FIGS. 6 and 9. The recesses 66 are retracted slightly from connection surfaces of the respective female auxiliary connectors 61.

First cam pins 67 project in substantially central parts of the opposite side surfaces of the female frame 62 with respect to the height direction and have oval cross sections that are longer in forward and backward directions FBD. Guide ribs 68 are formed below the corresponding first cam pins 67 and extend in substantially forward and backward directions FBD. The guide ribs 68 guide the connection of the two connectors 10, 60 and prevent an erroneous connection.

Figure 17:
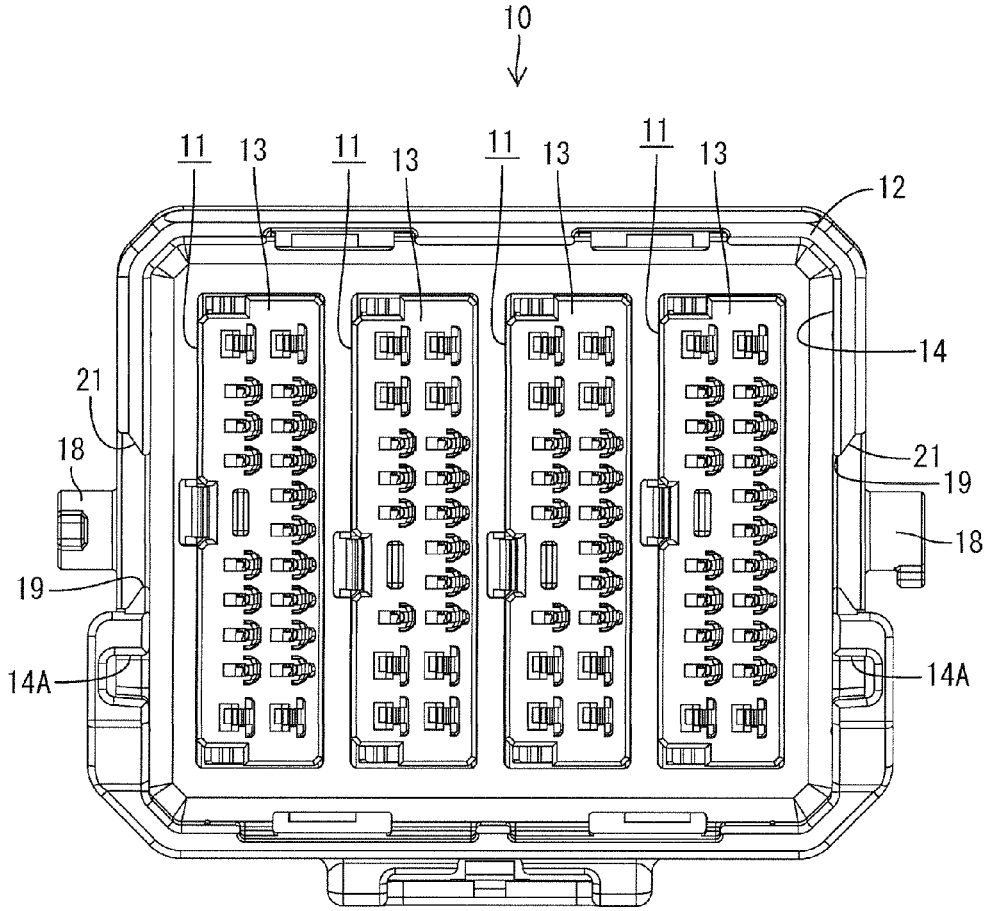
FIG. 17 is a front view of the male housing.

As shown in FIG. 17, the male connector 10 has male auxiliary connectors 11 assembled into a male frame 12 made e.g. of synthetic resin. Each male auxiliary connector 11 includes a male auxiliary housing 13 made e.g. of synthetic resin. The male housing mentioned herein is comprised of the male frame 12 and the plurality of male auxiliary housings 13.

A rectangular tubular receptacle 14 projects forward from the male frame 12 and from the periphery of a connection surface formed by the male auxiliary housings 13. Male auxiliary connector accommodating portions 16 penetrate the male frame 12 in forward and backward directions FBD for accommodating the male auxiliary connectors 11, as shown at the left side of FIG. 6. An interlocking portion 13A is provided on the outer surface of each male auxiliary housing 13 and a lock 16A is provided in each male auxiliary connector accommodating portion 16. The lock 16A engages the interlocking portion 13A when the male auxiliary connector 11 is inserted from behind to a proper insertion position in the male auxiliary connector accommodating portion 16 and prevents the male auxiliary connector 11 from coming out backward.

Cavities 15 penetrate the male auxiliary housing 13 in forward and backward directions FBD, as shown at the left side of FIG. 6, and are arranged substantially in the height direction in the male auxiliary connector 11, as shown in FIG. 17. The cavities 15 are configured to receive the male terminal fittings 70. Locking lances 16B and at least one retainer 17 engage the male terminal fittings 20 accommodated in the cavities 15 and prevent the male terminal fittings 20 from coming out backward. The terminal fittings 20, 70 are connected electrically when the two connectors 10, 60 are connected.

Figure 16:
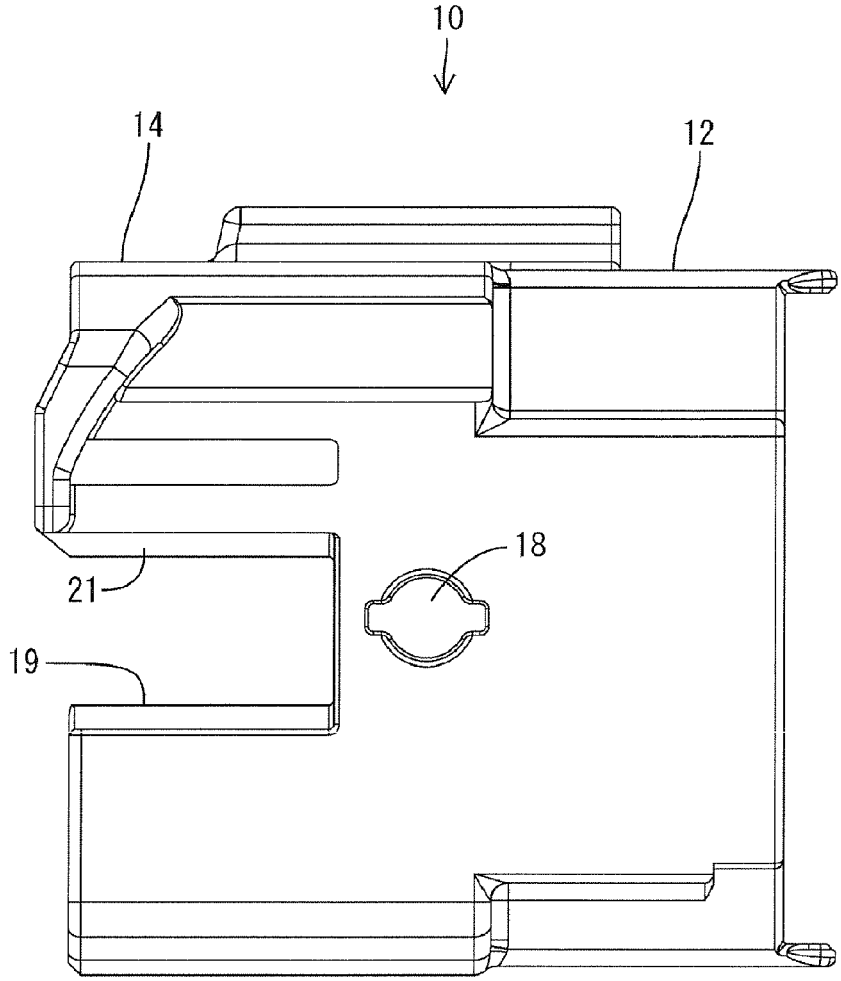
FIG. 16 is a side view of a male housing.

Supporting shafts 18 project from substantially central parts of the opposite side surfaces of the male frame 12 with respect to the height direction. Further, as shown in FIG. 16, escaping grooves 19 are formed in the opposite side surfaces of the male frame 12 and extend straight from the front opening edge of the receptacle 14 toward the supporting shafts 18. The first cam pins 67 enter the escaping grooves 19 when connecting the two connectors 10, 60.

Figure 8:
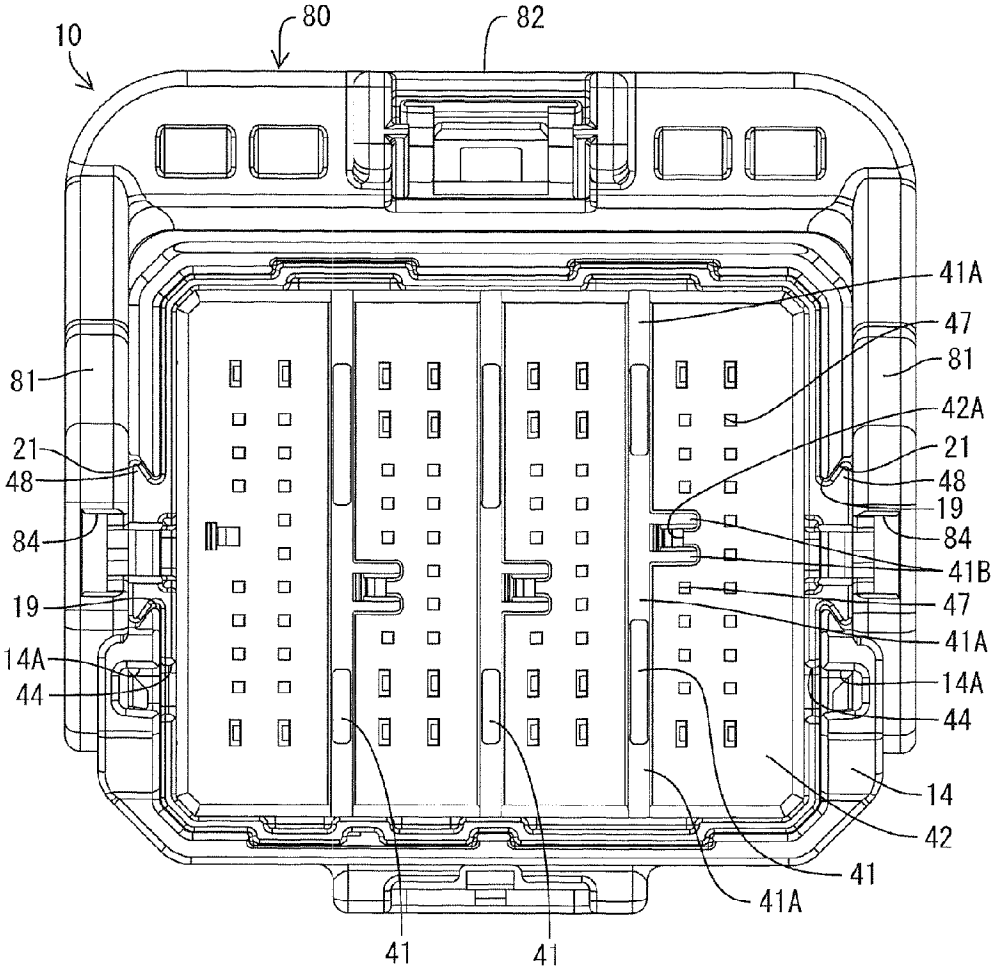
FIG. 8 is a front view of the male connector.

The connector assembly also includes a lever 80 that is made e.g. of synthetic resin. The lever 80 has left and right plate-like arms 81 and an operable portion 82 that connects the two arms 81. Thus, the lever 80 is substantially U-shaped, as shown in FIG. 8. The arms 81 have bearing holes 83 for receiving the supporting shafts 18. The lever 80 is rotatable about the supporting shafts 18 between a standby position (FIG. 1) where the arms 81 stand in the height direction and a connection position (FIG. 3) where the arms 81 cross the opposite outer side surfaces of the female connector 60 and the operable portion 82 is located behind the female connector 60. A lever lock 60A projects back from the rear surface of the female connector 60 and engages the operable portion 82 of the lever 80 at the connection position. An arcuate cam groove 84 is formed in the inner surface of the arm 81. The cam groove 84 is centered on the bearing hole 83 opens at the peripheral edge of the arm 81.

Figure 10:
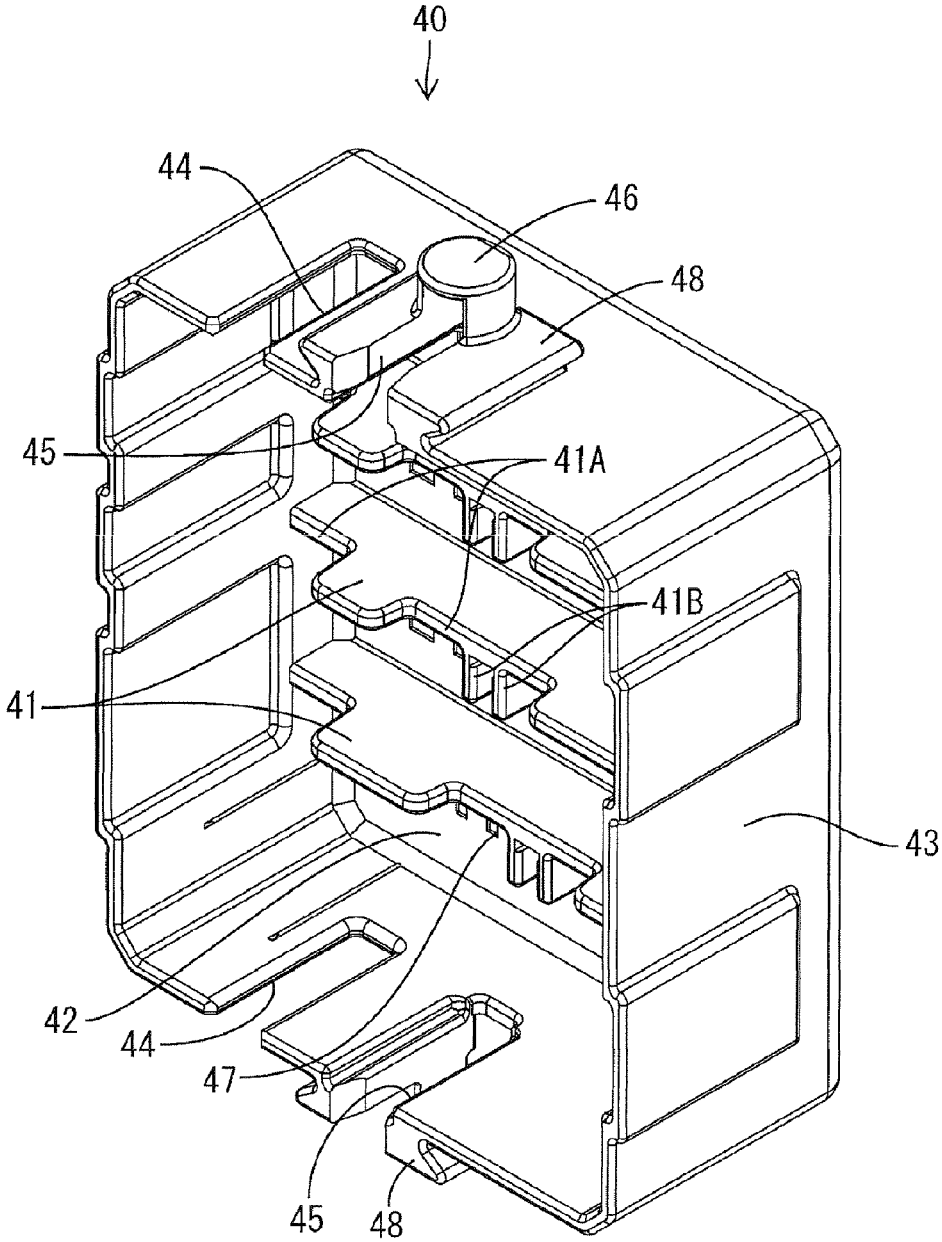
FIG. 10 is a perspective view of the moving plate.

The connector assembly also includes a moving plate 40 made e.g. of synthetic resin. The moving plate 40 is arranged in the receptacle 14 and functions to position the male terminal fittings 20 in vertical and horizontal directions. Here, the vertical and horizontal directions mean directions orthogonal to each other in a plane orthogonal to forward and backward directions FBD when forward and backward directions FBD are parallel with connecting and separating directions of the connectors 10, 60. The moving plate 40 is a substantially rectangular tube with a plurality of substantially plate-like walls and is movable in forward and backward directions FBD in the receptacle 14. As shown in FIG. 10, the moving plate 40 includes a substantially rectangular plate main body 42 aligned at a right angle to moving directions of the moving plate 40 and a rectangular tubular peripheral wall portion 43 that projects forward from the peripheral edge of the plate main body 42. The outer peripheral surface of the peripheral wall portion 43 slides substantially in contact with the inner peripheral surface of the receptacle 14 at the time of connecting the two connectors 10, 60. As shown in FIG. 8, cutouts 44 are formed in the inner surface of the peripheral wall portion 43 at positions corresponding to the guide ribs 68. Receiving grooves 14A are formed at positions of the inner surface of the receptacle 14 corresponding to the cutouts 44 for receiving the corresponding guide ribs 68.

Introducing grooves 45 are formed in the opposite side surfaces of the peripheral wall portion 43 at substantially central parts with respect to the height direction. The introducing grooves 45 extend in forward and backward directions FBD and are open at the front end edge of the peripheral wall portion 43 for receiving the first cam pins 67. Second cam pins 46 are formed on the opposite side surfaces of the peripheral wall portion 43 and straddle the introducing grooves 45. Each second cam pin 46 is substantially U-shaped when viewed from front, and the corresponding first cam pin 67 can fit into the inside of the second cam pin 46. The second cam pins 46 can engage the cam grooves 84 of the lever 80 while being united with the first cam pins 67 until the two connectors 10, 60 are connected completely. Thus, the female connector 60 and the moving plate 40 move integrally move by rotating the lever 80.

Figure 11:
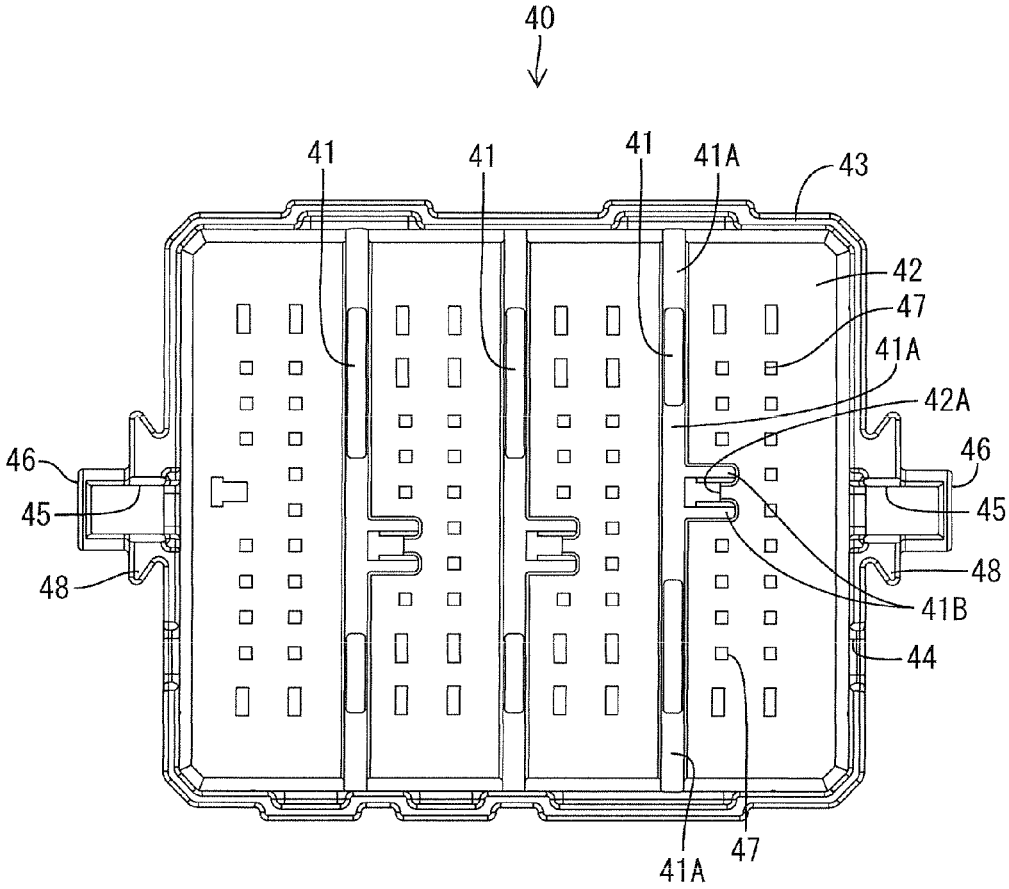
FIG. 11 is a front view of the moving plate.
Figure 12:
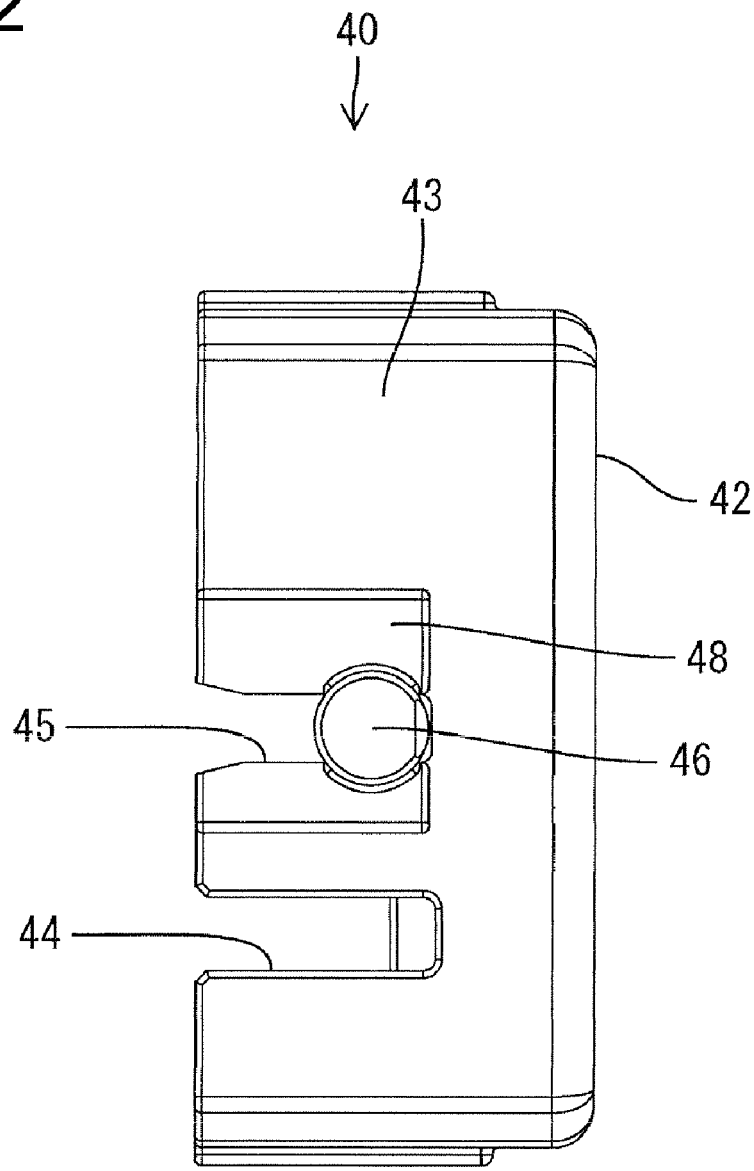
FIG. 12 is a side view of the moving plate.
Figure 13:
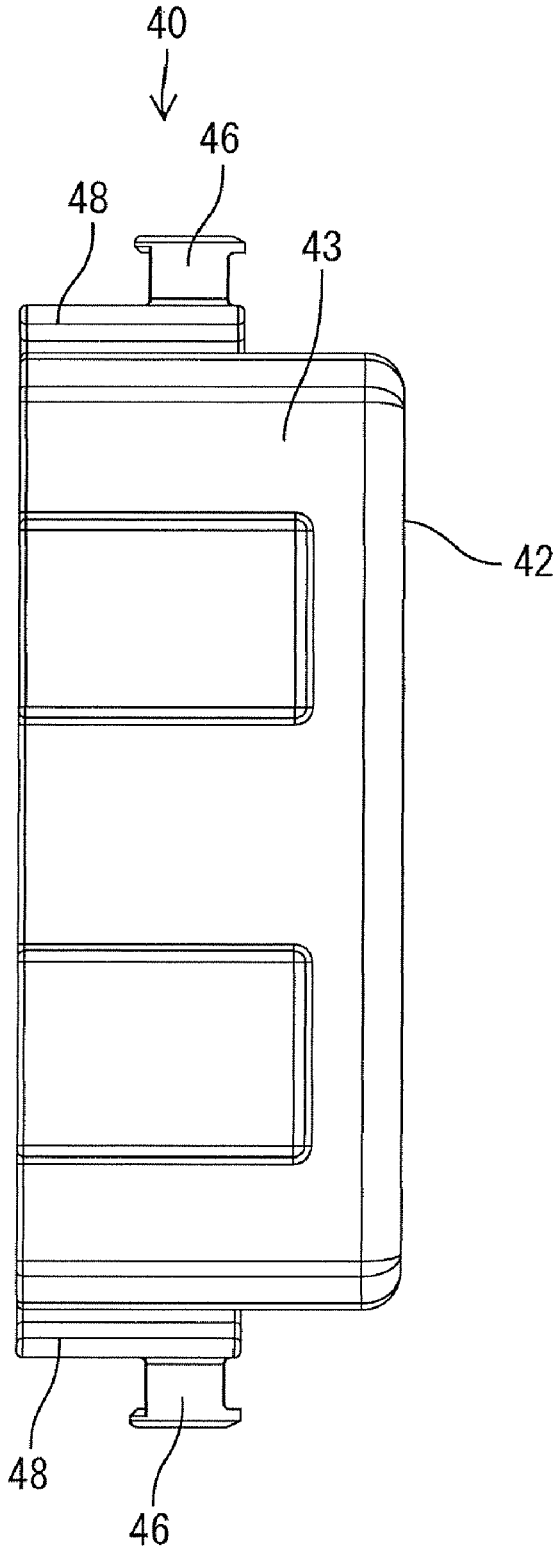
FIG. 13 is a plan view of the moving plate.
Figure 14:
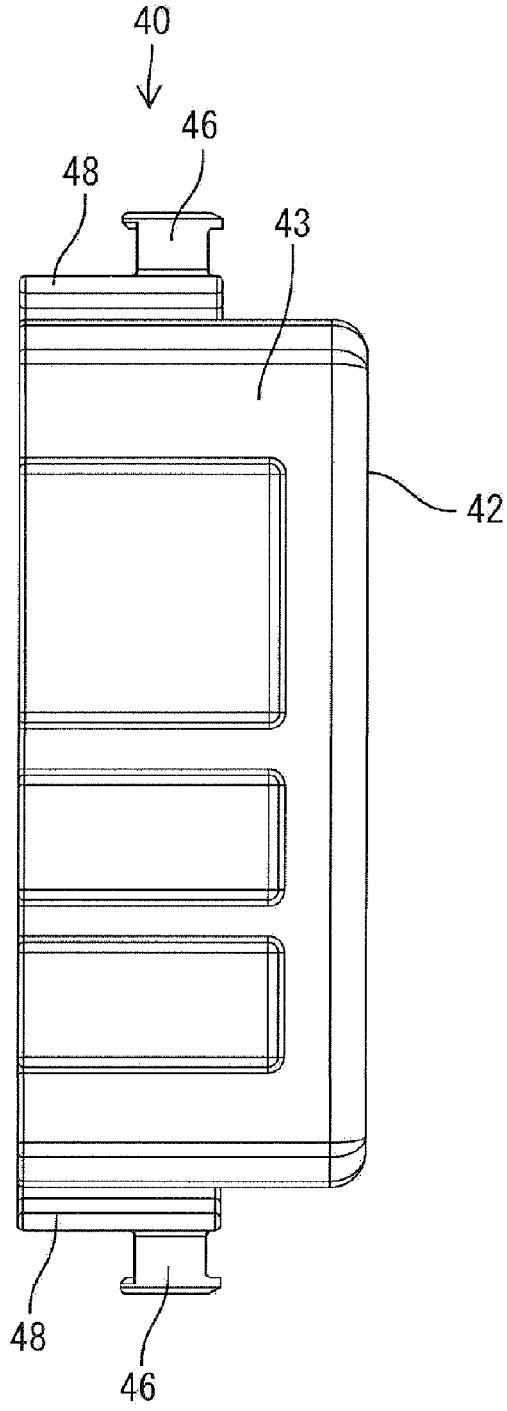
FIG. 14 is a bottom view of the moving plate.
Figure 15:
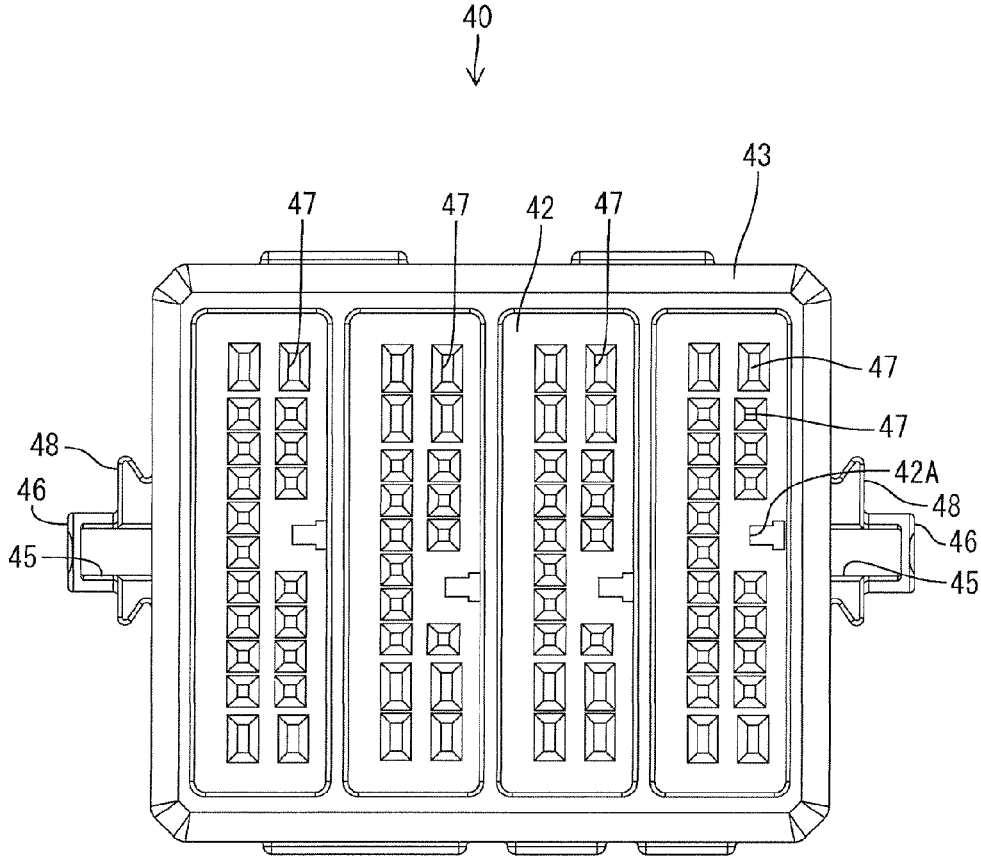
FIG. 15 is a rear view of the moving plate.

As shown in FIG. 11, restricting projections 48 project out from the outer side surfaces of the peripheral wall portion 43 at the opposite side walls of the introducing groove 45. The restricting projections 48 project in an overhanging or undercut manner from opposite side surfaces of the peripheral wall portion 43 and extend in forward and backward directions FBD, as shown in FIGS. 12 to 14. On the other hand, as shown in FIG. 17, two restricting recesses 21 are formed in the inner peripheral surface of the receptacle 14 for receiving the restricting projections 48. The restricting recesses 21 and the restricting projections 48 both have dovetail shapes and are engageable with each other. Thus, even if the peripheral wall portion 43 is indented inwardly in the molding process, the peripheral wall portion 43 can be corrected to a proper posture by the engagement of the restricting projections 48 and the both restricting recesses 21.

Positioning holes 47 penetrate the plate main body 42, as shown in FIG. 11, and are arrayed to receive the respective male terminal fittings 21. As shown in detail in FIG. 15, the positioning holes 47 widen toward the rear surface of the plate main body 42 and hence guide the respective male terminal fittings 20 and ensure proper positioning of the respective male terminal fittings 20. The moving plate 40 is moved from an initial position IP where the plate main body 42 is distanced from the front surfaces of the respective male auxiliary connectors 11 to an end position reached upon completing the connecting operation by bringing the plate main body 42 into contact with the front surfaces of the respective male auxiliary connectors 11 when connecting the two connectors 10, 60. The male terminal fittings 20 remain inserted through the positioning holes 47 at all points along this moving path and therefore are positioned reliably. Leading ends of the male terminal fittings 20 project from the front surface of the plate main body 42 and are at the connection surface side when the moving plate 40 is at the initial position IP, as shown in FIG. 6. In this state, an electrical connection test can be conducted. It should be noted that the leading ends of the respective male terminal fittings 20 are at substantially the same position in the receptacle 14 in forward and backward directions FBD.

Protection walls 41 project forward from the front surface of the plate main body 42 as shown in FIG. 10. The protection walls 41 are provided in correspondence with the recesses 66 in the front surface of the female connector 60. Specifically, the respective female auxiliary connectors 61 are partitioned by the protection walls 41 when connecting the two connectors 10, 60. This means that the protection walls 41 are at positions partitioning the respective male auxiliary connectors 11. In other words, if the male terminal fittings 20 arranged in any one of the male auxiliary connectors 11 are assumed to be a male terminal fitting group 20, the protection walls 41 are arranged between adjacent male terminal fitting groups 20. Accordingly, if the positioning holes 47 that receive the male terminal fittings 20 of one male terminal fitting group 20 are assumed to be a positioning hole group 47, then the protection walls 41 are arranged between the adjacent positioning hole groups 47, as shown in FIG. 11.

The protection walls 41 project perpendicularly from the front surface of the plate main body 42 and opposite lateral edges of each protection wall 41 are connected with the peripheral wall portion 43. Specifically, the protection walls 41 connect two walls of the peripheral wall portion 43 where no second cam pin 46 is provided. As a result, the protection walls 41 are substantially parallel to walls of the peripheral wall portion 43 where the second cam pins 46 are provided. Thus, the connection of the opposite lateral edges of the protection wall 41 with the peripheral wall portion 43 prevents the protection walls 41 from inclining toward the plate main body 42 and increases the rigidity of the entire moving plate 40.

Three cutouts 41A are formed in a widthwise intermediate position and near the opposite widthwise ends of the front end portion of each protection wall 41. The locking portion 64A of the female connector 60 is located in the middle cutout 41A when connecting the two connectors 10, 60. In other words, the interference of the protection walls 41 and the locking portions 64A are avoided by the middle cutouts 41A at the time of connecting the two connectors 10, 60.

Two facing walls 41B are connected with each protection wall 41 at positions substantially corresponding to the middle cutouts 41A to project lateral to the protection wall 41. Thus, the protection wall 41 is prevented from being inclined toward the front surface of the plate main body 42. Further, the front ends of the facing walls 41B are substantially flush with the front ends of the cutouts 41A. Accordingly, an area that can interfere with the female connector 60 increases when the female connector 60 is inserted in an improper posture into the receptacle 14. Thus, the female connector 60 interferes more easily with the protection walls 41 or the facing walls 41B. Therefore, the deformation of the male terminal fittings 20 are prevented effectively.

As shown in FIG. 11, a passage hole 42A penetrates the plate main body 42 at a position between each pair of facing walls 41B for permitting passage of a disengagement jig for disengaging the lock 16A. Accordingly, the lock 16A and the interlocking portion 13A can be disengaged by inserting the disengagement jig through the passage hole 42A. At this time, the facing walls 41B prevent the disengagement jig from contacting the male terminal fittings 20 when the disengagement jig is inserted into the passage hole 42A between the facing walls 41B. Therefore, the male terminal fittings 20 cannot be deformed.

Figure 7:
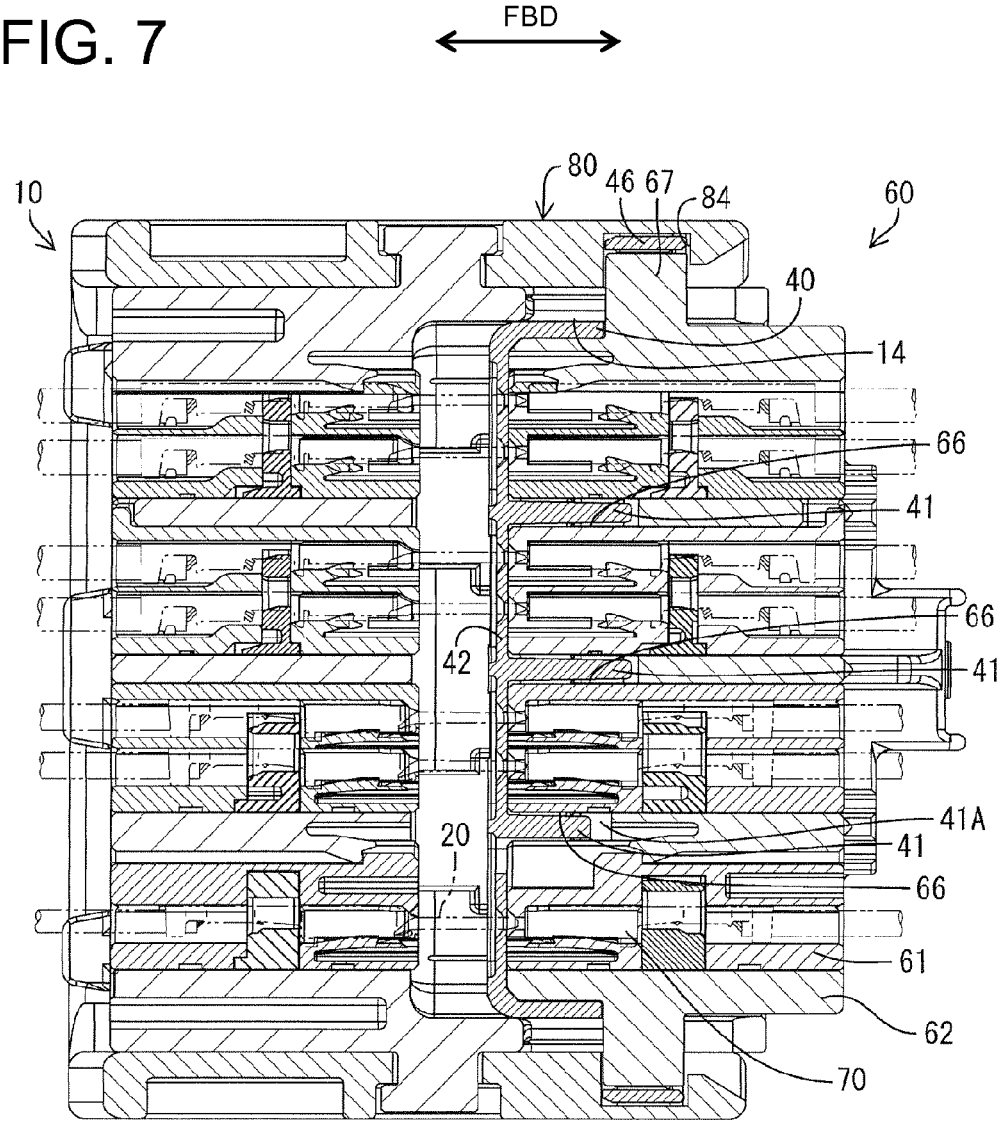
FIG. 7 is a side view in section showing a state where the female connector is properly connected with the moving plate at the initial position in the receptacle.

As shown in FIG. 7, the protection walls 41 are thinned toward the front and the inner and outer edges of the front ends of the protection walls 41 are beveled or rounded. Thus, the opposite side surfaces 41 of the protection walls 41 guide the protection walls 41 into the recesses 66 when connecting the two connectors 10, 60. Accordingly, the protection walls 41 are inserted into the recesses 66 of the female connector 60 and the moving plate 40 is movable in the receptacle 14 while being positioned.

Figure 4:
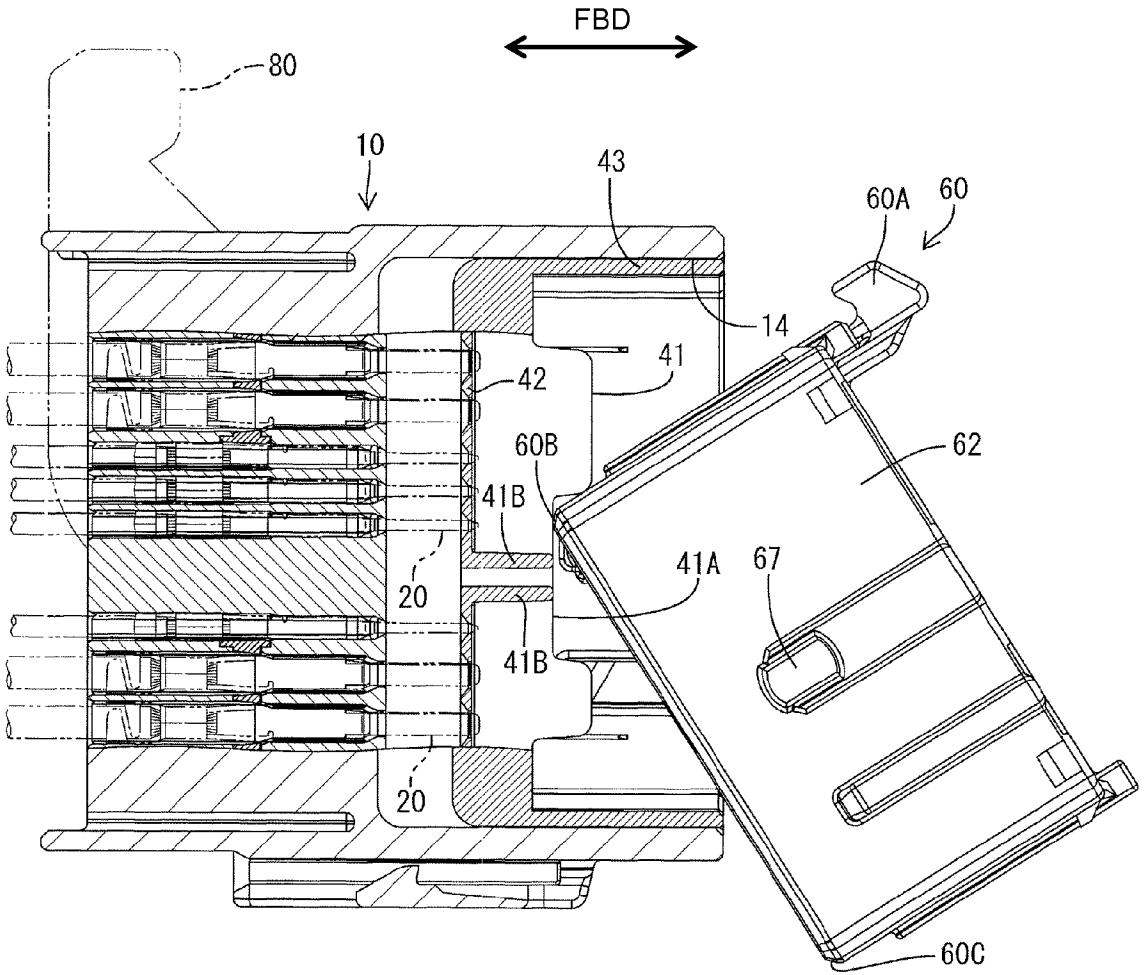
FIG. 4 is a side view in section showing a female connector inserted into a receptacle in an improper posture vertically inclined with respect to a connecting direction.
Figure 5:
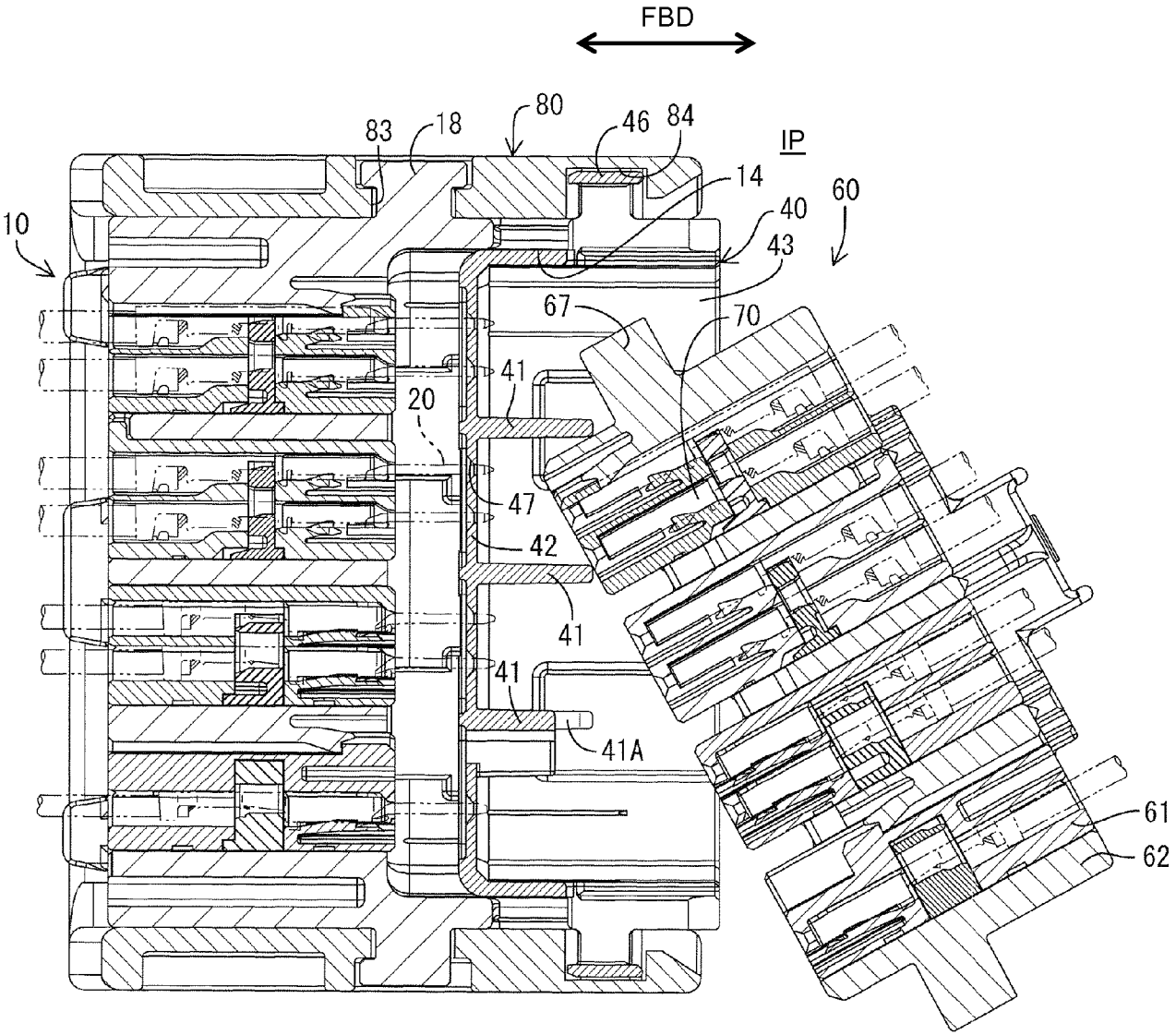
FIG. 5 is a side view in section showing the female connector inserted into the receptacle in an improper posture horizontally inclined with respect to the connecting direction.

As shown in FIG. 6, a projecting amount of the protection walls 41 from the front surface of the plate main body 42 is larger than a projecting amount of the leading ends of the male terminal fittings 20 forward from the positioning holes 47. Thus, a corner of the female connector 60 cannot collide with the leading ends of the male terminal fittings 20 and to prevent the damage of the male terminal fittings 20 will not be damaged even if the female connector 60 is inserted into the receptacle 14 in an improper posture while the moving plate 40 is at the initial position IP in the receptacle 14, as shown in FIG. 4 or 5.

More particularly, the female connector 60 is a block having a substantially square cross section and the male connector 10 includes the receptacle 14 having a substantially square opening. Thus, any of four corners of the connection surface of the female connector 60 has an equal probability of being inserted in the lead into the receptacle 14. If a protection wall projects around a collective group of the positioning holes 47, the male terminal fittings 20 are damaged more easily if any of the corners of the connection surface of the female connector 60 enters a central part of the hole group. In this respect, the protection walls 41 are arranged between the adjacent male terminal fitting groups 20. Thus, even if the corner of the connection surface of the female connector 60 enters through the central part of the front surface of the receptacle 14, the adjacent protection walls 41 contact any adjacent two sides of the connection surface of the female connector 60, and the corner of the connection surface cannot damage the leading ends of the male terminal fittings 20.

As described above, the protection walls 41 project forward from the front surface of the plate main body 42, as shown in FIG. 10. The protection walls 41 are provided in correspondence with the recesses 66 formed in the front surface of the female connector 60. Specifically, the protection walls 41 are arranged to partition the respective female auxiliary connectors 61 when connecting the two connectors 10, 60. In other words, the protection walls 41 are provided at positions to partition the respective male auxiliary connectors 11.

The protection walls 41 project perpendicularly from the front surface of the plate main body 42. The opposite lateral ends of each protection wall 41 are connected with the peripheral wall portion 43. Specifically, the protection walls 41 are arranged between two walls of the peripheral wall portion 43 where no second cam pin 46 is provided. As a result, the protection walls 41 are substantially parallel to walls 43A of the peripheral wall portion 43 that have the second cam pins 46. The unitary connection of the lateral ends of the protection walls 41 to the walls of the peripheral wall portion 43 prevents the protection walls 41 from inclining toward the front surface of the plate main body 42 and increases the rigidity of the plate main body 42.

Cutouts 41A are formed substantially in the widthwise center and the opposite widthwise ends of the front end portion of each protection wall 41. The locking portion 64A of the female connector 60 is in the middle one 41A of the three cutouts 41A while connecting the connectors 10, 60. In other words, the middle cutout 41A avoids interference of the protection walls 41 and the locking portions 64A when connecting the two connectors 10, 60.

Figure 18:
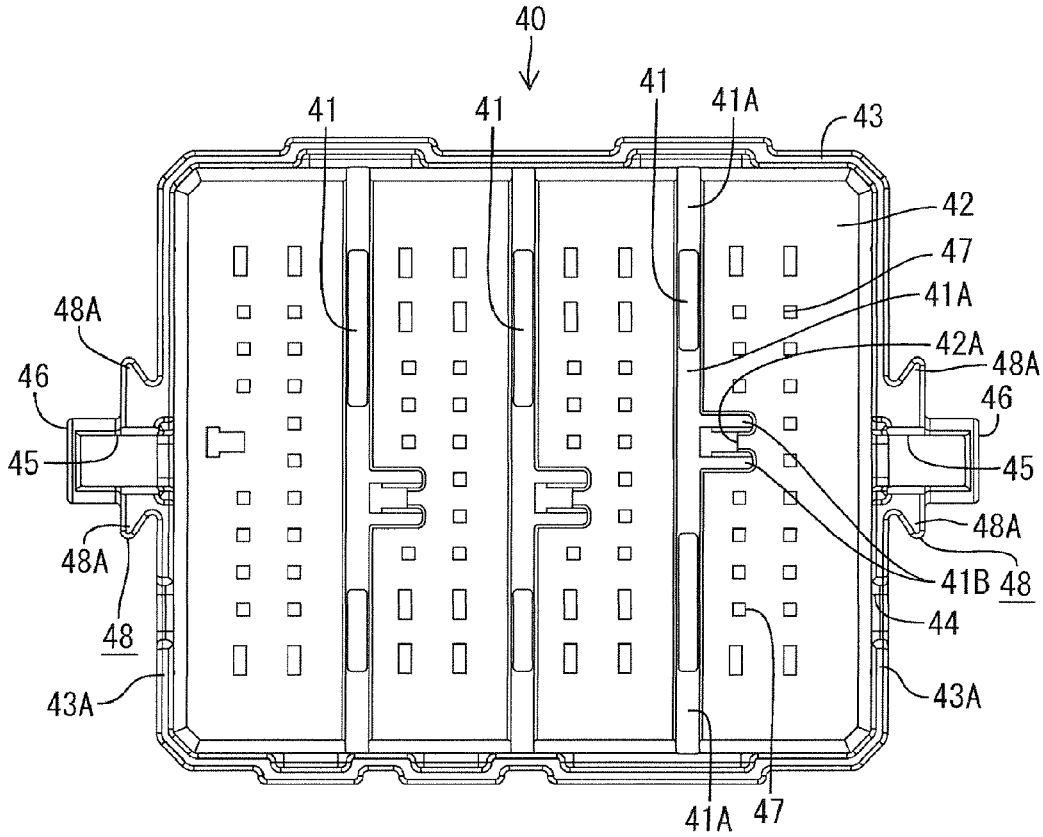
FIG. 18 is a front view of the moving plate.

Two facing walls 41B project laterally from the protection wall 41 at opposite sides of the middle cutouts 41A. As shown in FIG. 18, at least one passage hole 42A penetrates the plate main body 42 at a position corresponding to the spacing between each pair of facing walls 41B for permitting insertion of a disengagement jig for disengaging the lock 16A. Accordingly, the disengagement jig can be passed through the passage hole 42A to disengage the lock 16A from the interlocking portion 13A even though the moving plate 40 is accommodated in the receptacle 14. The facing wall 41B prevent the disengagement jig inserted into the passage hole 42A from contacting and deforming the male terminal fittings 20.

As shown in FIG. 7, the protection walls 41 are thinned and beveled to converge toward the front. The converging opposite edges of the front ends of the protection walls 41 guide the protection walls 41 into the recesses 66 of the female connector 60 and the moving plate 40 is movable in the receptacle 14 while being positioned.

As shown in FIG. 6, a projecting amount of the protection walls 41 from the front surface of the plate main body 42 is larger than an amount of the leading ends of the male terminal fittings 20 projecting forward from the positioning holes 47. Thus, a peripheral edge of the connection surface of the female connector 60 will not collide with the leading ends of the male terminal fittings 20 and cannot damage the male terminal fittings 20 even if the female connector 60 is inserted into the receptacle 14 in an improper posture with the moving plate 40 accommodated at the initial position in the receptacle 14.

Figure 19:
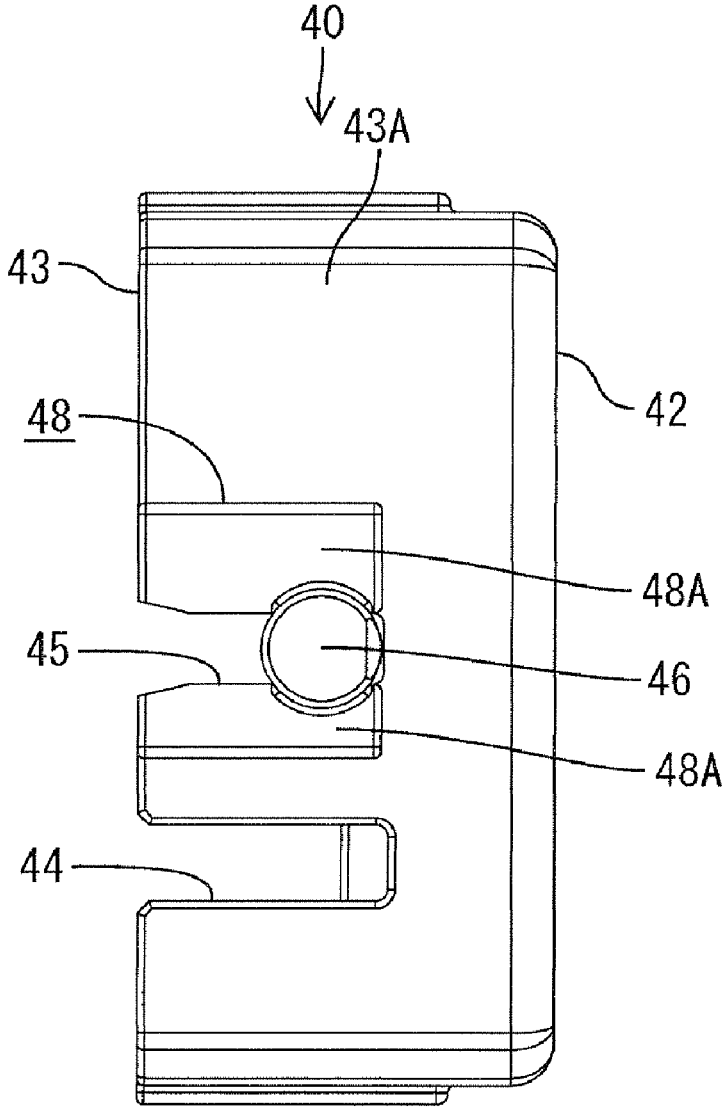
FIG. 19 is a side view of the moving plate.
Figure 20:
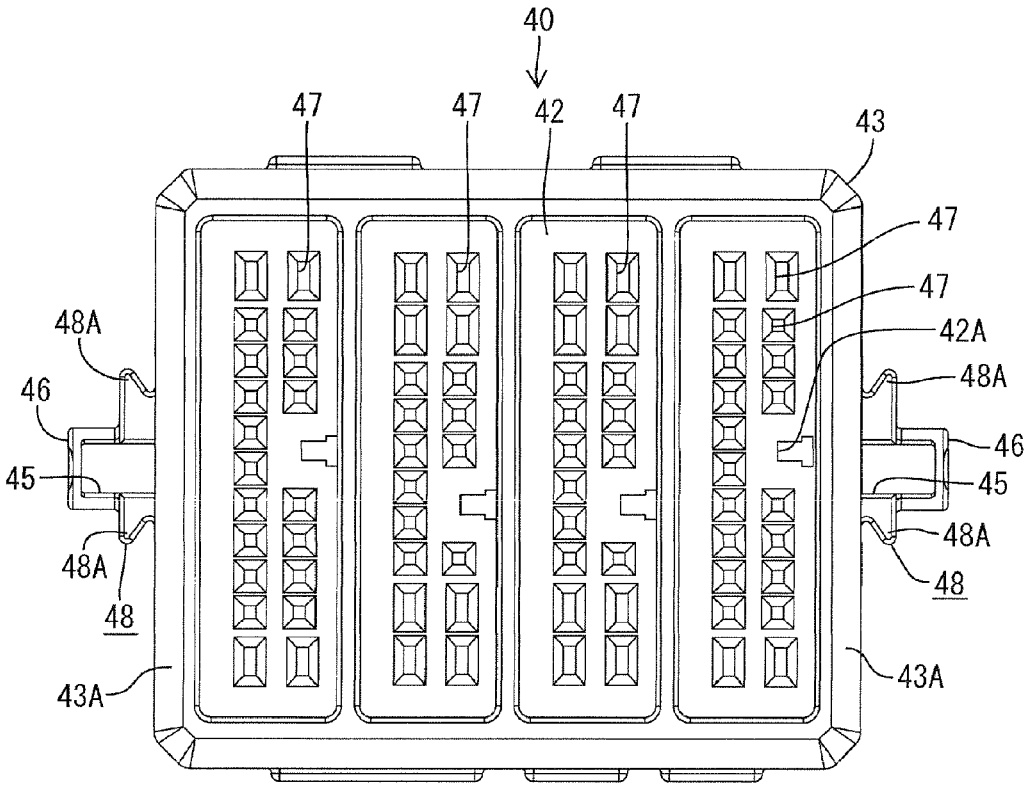
FIG. 20 is a rear view of the moving plate.
Figure 21:
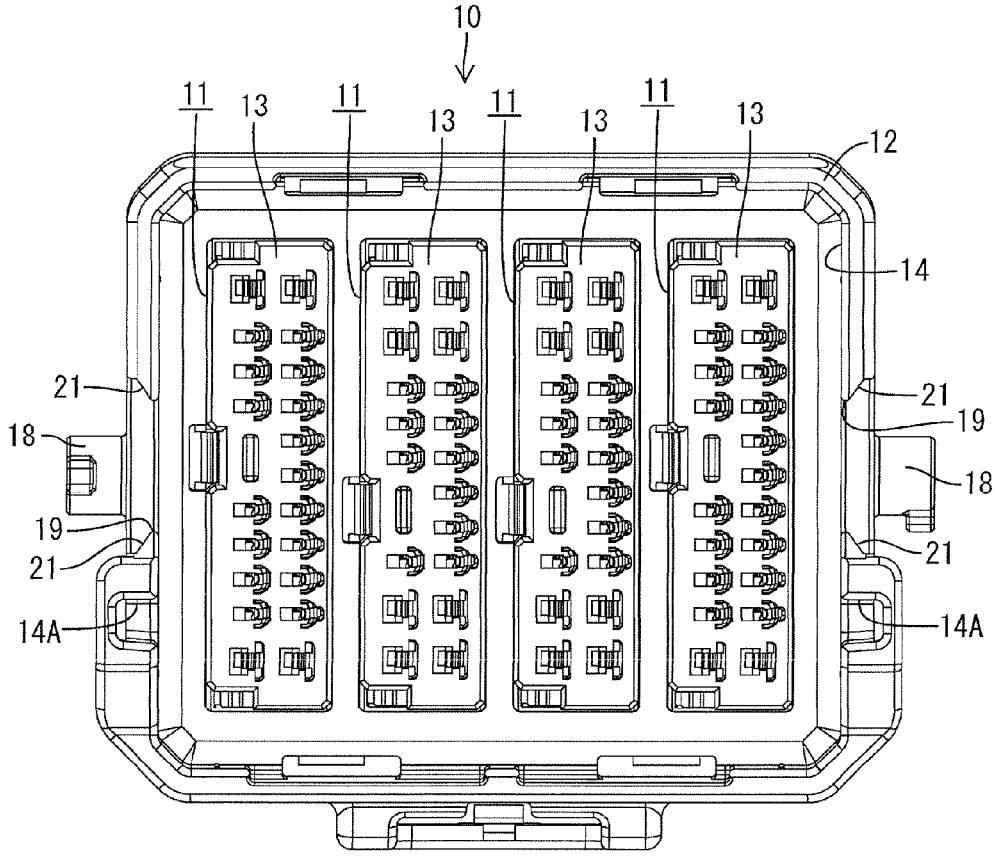
FIG. 21 is a front view of a male housing.

As shown in FIG. 18, two restricting projections 48 project out from the outer surfaces of the two walls 43A of the peripheral wall portion 43 facing each other at left and right sides. The two restricting projections 48 are at positions corresponding to substantially central parts of opening edges of the two walls 43A. Each restricting projection 48 includes two projections 48A arranged to face the outer surface of the corresponding wall 43A, and these two projections 48A project in substantially opposite vertical directions along the outer surface of the wall 43A. The two projections 48A project from the two side walls forming the introducing groove 45. Thus, the two projections 48A utilize both side walls of the introducing groove 45. As shown in FIG. 19, the two restricting projections 48 extend in forward and backward directions FBD.

Figure 22:
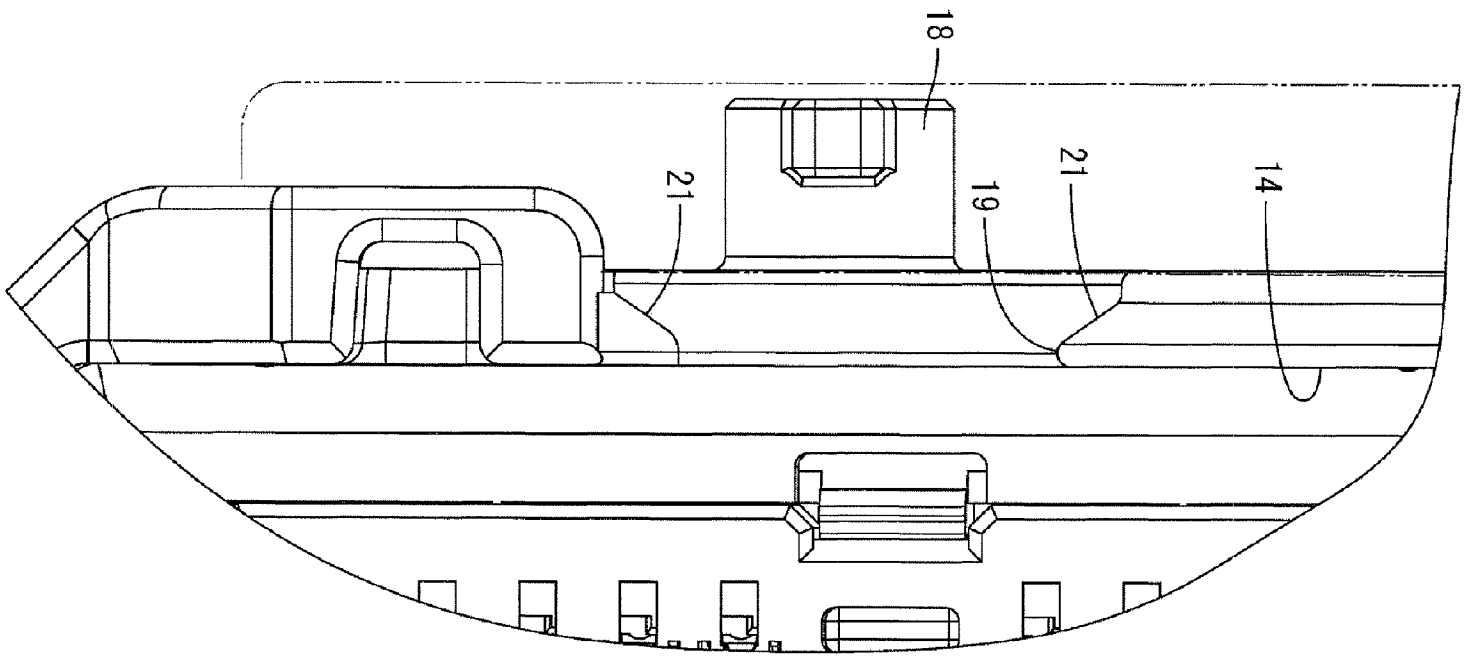
FIG. 22 is an enlarged view of locking edge portions.
Figure 23:
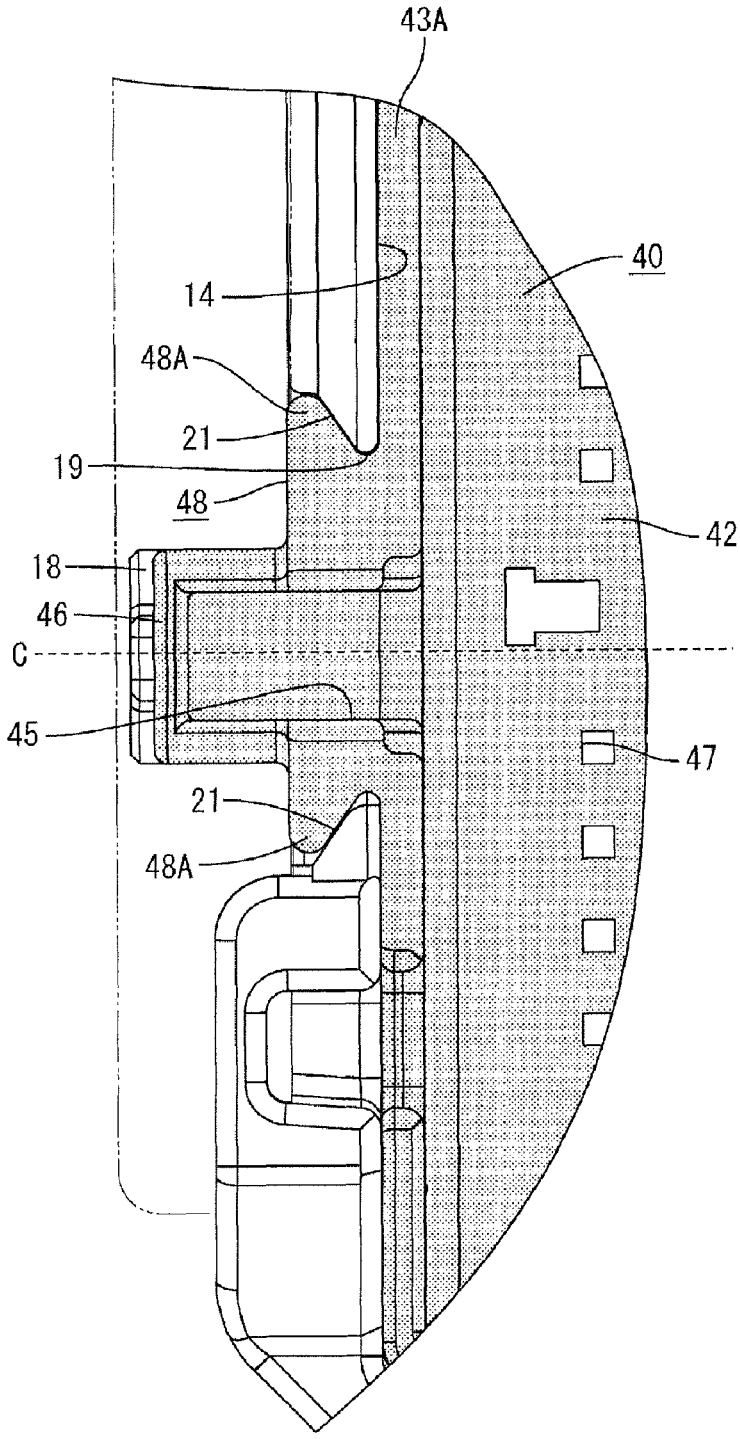
FIG. 23 is an enlarged view showing a state where two projections are engaged with the two locking edge portions.
Figure 24:
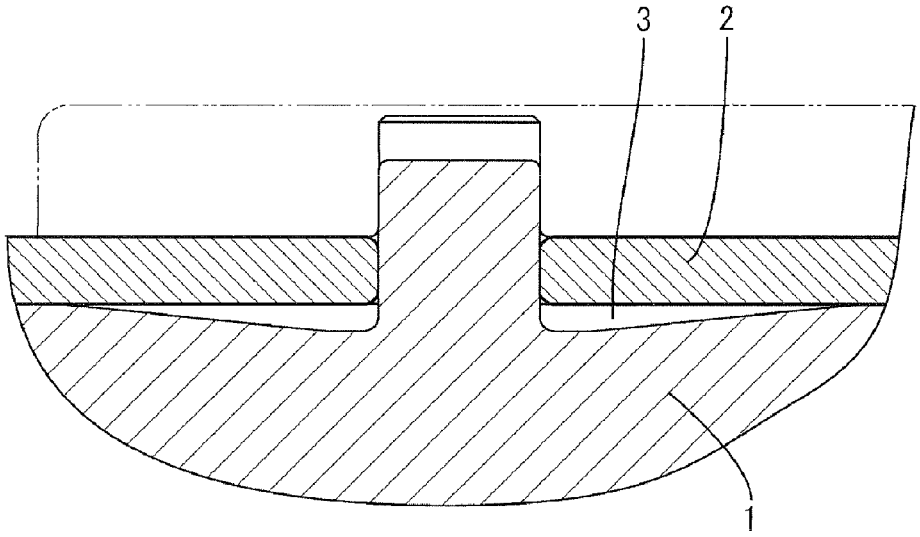
FIG. 24 PRIOR ART
FIG. 24 is a diagram showing a state where a clearance is formed between a moving plate and a receptacle in a prior art.

As shown in FIG. 22, two locking edges 21 are provided at positions of the receptacle 14 for engaging the restricting projections 48 and correcting the peripheral wall portion 43 to a proper posture. The two locking edges 21 are formed by slanting outer sides of the opposite lateral edges forming the upper and lower sides of the escaping groove 19. As shown in FIG. 23, the locking edges 21 are engageable with the dovetailed restricting projection 48. Thus, even if the two walls 43A are indented inwardly in a molding process, the two walls 43A are corrected to proper postures by engaging the respective restricting projections 48 and the corresponding locking edges 21. Therefore, the connecting operation of the connectors 10, 60 is not hindered by interference of the connection surface of the female connector 60 with the opening edge of the peripheral wall portion 43 at the time of connecting the connectors 10, 60.

The two projections 48A preferably are so arranged as to be asymmetric with respect to an axis C passing between the two projections 48A. Thus, if an attempt is made to mount the moving plate 40 in a wrong vertically inverted posture into the receptacle 14, an erroneous mounting operation is prevented, wherefore the moving plate 40 can be properly mounted into the receptacle 14.

Figure 2:
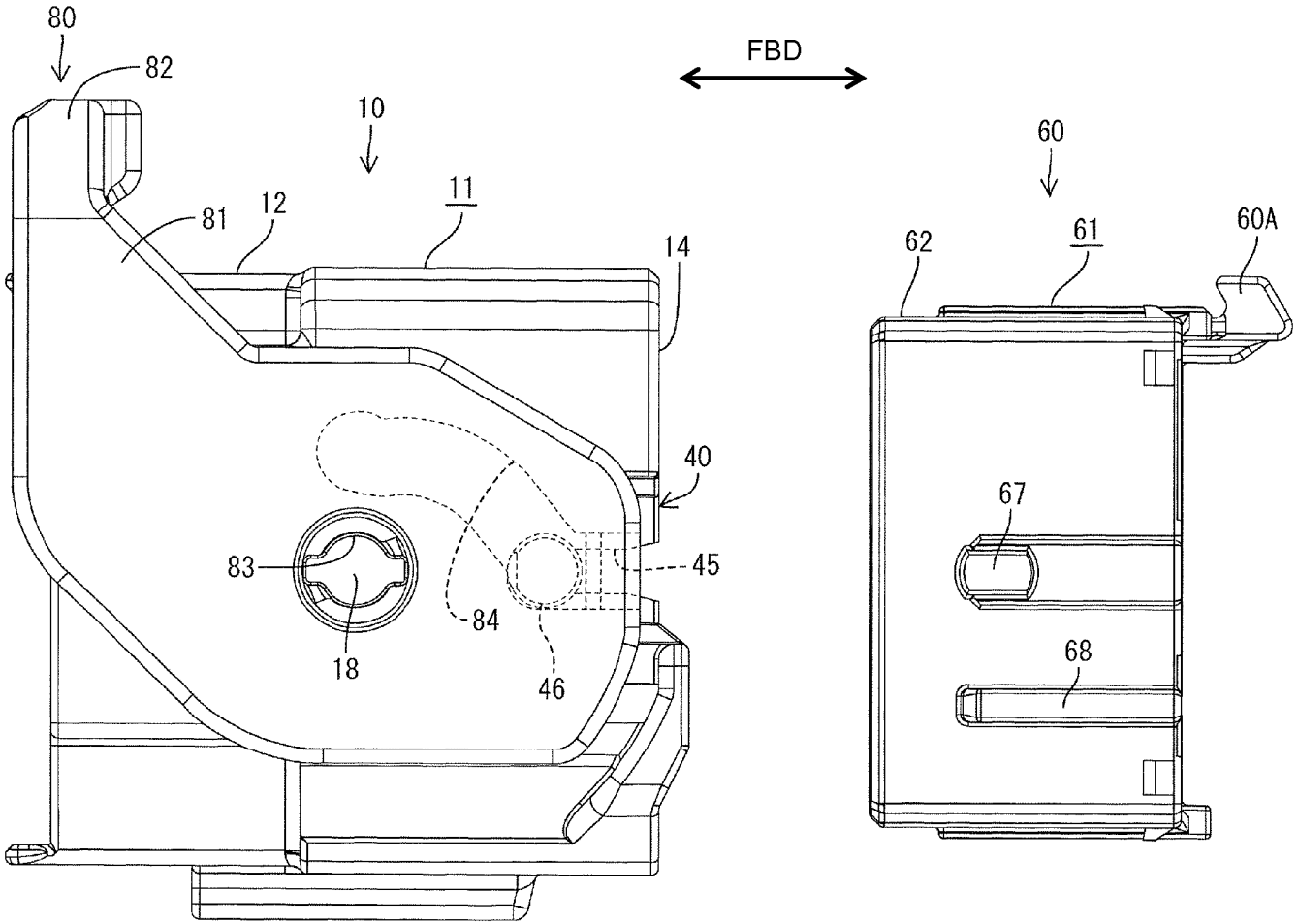
FIG. 2 is a side view showing the moving plate mounted at an initial position in the male connector and the two connectors are connected.

The moving plate 40 is at the initial position IP and the lever 80 is at the standby position as shown in FIG. 2 upon connecting the male and female connectors 10 and 60. Additionally, the outer peripheral surface of the peripheral wall portion 43 can slide along the inner peripheral surface of the receptacle 14, as shown in FIG. 6. In this state, the female connector 60 is inserted into the receptacle 14 from the front. The female connector 60 may be inserted into the receptacle 14 in a proper posture, as shown in FIG. 7, so that the front surface of the female connector 60 extends in a direction substantially perpendicular to a forward-and-backward axis and is aligned with the height direction. In this situation, the female connector 60 is fit into the moving plate 40 so that the side surfaces of the female connector 60 are surrounded by the peripheral wall portion 43 and the front surface of the female connector 60 faces the front surface of the plate main body 42. Additionally, as shown in FIG. 2, the first cam pins 67 are at the entrances of the cam grooves 84 of the lever 80 and in the introducing grooves 45 and are engageable with the cam grooves 84 while being united with the first cam pins 46.

Figure 3:
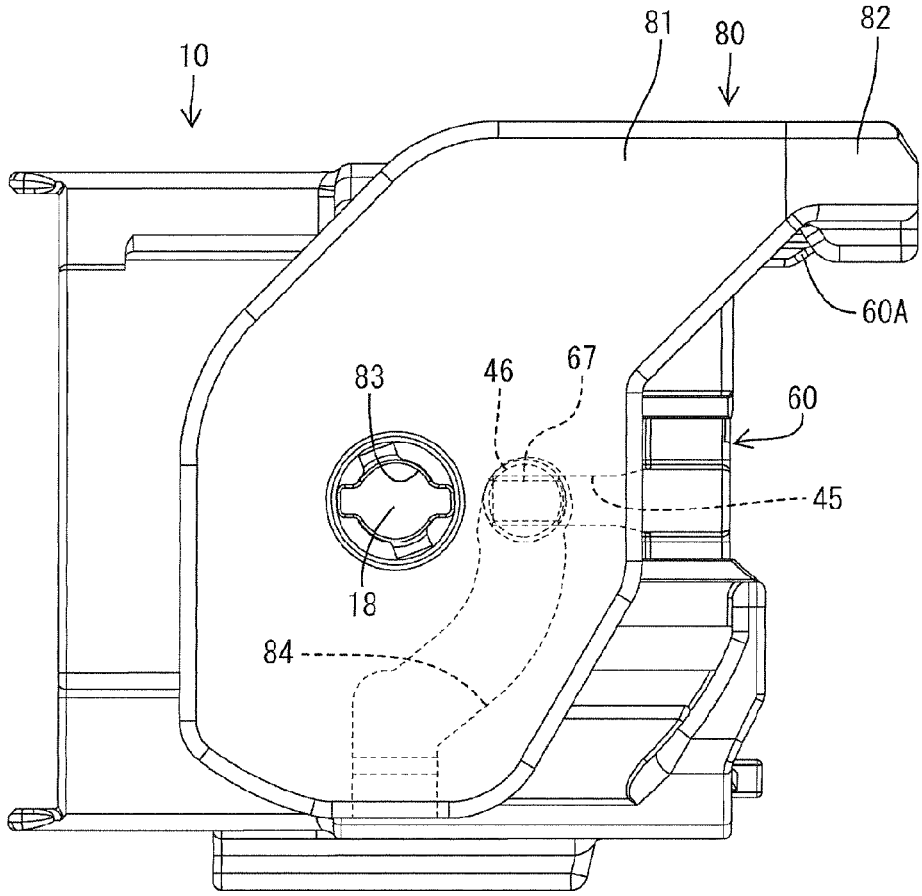
FIG. 3 is a side view showing the two connectors connected.

The lever 80 then is rotated toward the connection position. As a result, the female connector 60 is displaced toward the back side of the receptacle 14 at least partly by a cam action caused by the engagement of the second cam pins 46 and the cam grooves 84. Thus, the two connectors 10, 60 move closer together. At this time, the protection walls 41 of the plate main body 42 fit into the recesses 66 of the female connector 60 and the moving plate 40 and the female connector 60 integrally move substantially in parallel toward the back side of the receptacle 14. The male terminal fittings 20 remain inserted through the positioning holes 47 while the moving plate 40 is moving and are held at substantially correct positions. Thus, the male terminal fittings 20 are inserted into the female terminal fittings 70, thereby gradually increasing connection depths with the female terminal fittings 70. The two connectors 10, 60 are connected properly, as shown in FIG. 3, when the moving plate 40 reaches the end position and the lever 80 reaches the connection position. As a result, the male terminal fittings 20 are connected with the female terminal fittings 70 to proper depths and the terminal fittings 20, 70 are connected electrically.

On the other hand, the female connector 60 is inserted into the receptacle 14 in an improper posture so that one corner 60B of the female connector 60 is inserted into the receptacle 14 before other corners 60C. Thus, the female connector 60 is inserted into the receptacle 14 while the front surface thereof is inclined vertically with respect to forward and backward directions FBD as shown FIG. 4 or the female connector 60 is inserted into the receptacle 14 while the front surface thereof is horizontally inclined with respect to forward and backward directions FBD as shown FIG. 5. As a result, the one corner 60B contacts the front ends of the two adjacent protection walls 41 and rests thereon. At this time, the one corner 60B straddles the male terminal fittings 20 arranged between the two adjacent protection walls 41 and the opposite widthwise ends thereof are in contact with the two protection walls 41. However, a widthwise intermediate part thereof is not in contact with the male terminal fittings 20. Accordingly, even if the female connector 60 is inserted into the receptacle 14 in the improper posture, there is no likelihood that the one corner portion 60B of the female connector 60 will contact the leading ends of the male terminal fittings 20, i.e. the protection walls 41 protect the male terminal fittings 20. The front surface of the female connector 60 could be displaced vertically or horizontally with respect to forward and backward directions FBD. However, this displaced front surface contacts the opening edge of the receptacle 14 so that the female connector 60 will not enter the receptacle 14. Hence, it is sufficient to consider only cases where the front surface of the female connector 60 is vertically or horizontally inclined with respect to the forward and backward directions FBD as states in which the female connector 60 is inserted in an improper posture into the receptacle 14.

As described above, the one corner 60B of the female connector 60 contacts the front ends of the protection walls 41 if the female connector 60 is inserted into the receptacle 14 in an improper posture. Thus, contact with the male terminal fittings 20 is avoided and plastic deformation of the male terminal fittings 20 is prevented. Further, the protection walls 41 are thinned toward the front and are guided into the recesses 66. Furthermore, the cutouts 44 are formed in the front end portions of the protection walls 41. Thus, interference of the protection walls 41 and the locks 64A can be avoided by accommodating the locks 64A in the cutouts 44.

The peripheral wall portion 43 of the moving plate 40 could be indented inwardly due to sinks during molding. However, the two projections 48A of each restricting projection 48 engage the corresponding locking edges 21 and pull the two walls 43A outwardly into correct the posture of the peripheral wall portion 43 as the moving plate 40 is mounted into the receptacle 14. This similarly holds in the case where the two walls 43A are formed to bulge outward, and the posture of the moving plate 40 can be corrected by mounting the moving plate 40 into the receptacle 14 while resiliently deforming the two walls 43A inwardly.

The moving plate 40 can be corrected to the proper posture by engaging the projections 48A with the corresponding locking edges 21. The projections 48A project in the opposite directions from the two side walls forming the introducing groove 45. Thus, the two projections 48A and two locking edge portions 21 are held in dovetail engagement. Further, the two projections 48A utilize the side walls of the introducing groove 45 to simplify the construction of the restricting projection 48. Furthermore, the two projections 48A are asymmetric with respect to the axis C to prevent en erroneous mounting operation of the moving plate 40.

The invention is not limited to the above described and illustrated embodiment. For example, the following embodiments are also included in the technical scope of the present invention.

The cutouts 44 are located more forward than the leading end portions of the male terminal fittings 20 when the moving plate 40 is at the initial position in the illustrated embodiment. However, other structure can be provided for preventing deformation even if the cutouts 44 are more backward than the leading end portions of the male terminal fittings 20 at the initial position.

Although the opposite lateral edges of the protection walls 41 are connected with the peripheral wall portion 43 in the above embodiment, they may not be connected with the protection walls 41 according to the present invention. Further, the moving plate 40 may not include the peripheral wall portion 43.

The male terminal fittings 20 in each male auxiliary connector 11 are defined as one male terminal fitting group in the above embodiment. However, a plurality of male terminal fittings 20 arranged in one of plural rows of male terminal fittings 20 may be defined as one male terminal fitting group 20 and male terminal fittings 20 arranged in the other rows may be defined to be other male terminal fitting groups 20.

The front ends of the protection walls 41 are more forward than the leading ends of the male terminal fittings 20 in the above embodiment. However, the front ends of the protection walls 41 and the leading end portions of the male terminal fittings 20 may be substantially aligned at the same position.

The invention may be applied to a connector other than a lever-type connector. Moreover, the lever may be substantially linearly displaced (such as a slider) or displaced along any other path to display a cam action. The connection of the two housings 10, 60 may be fully performed or only assisted by the cam action of the lever or movable member.

Although the protection walls 41 are thinned toward the leading ends in the above embodiment, they may have a constant width.

The cutouts 44 are in the opposite widthwise ends and the widthwise center of the front end portion of each protection wall 41 in the above embodiment. However, the cutout 44 may be formed only in the widthwise center of the front end portion of each protection wall 41 or the cutout 44 may not be formed at all.

Both facing walls 41B are connected with each protection wall 41 in the above embodiment. However, a single reinforcing wall may be provided instead of the two facing walls 41B according to the present invention. In this case, no introducing hole 42A may be provided.

Restricting projections 48 are provided on the opposite left and right walls 43A of the peripheral wall portion 43 in the above embodiment, but they may be on the opposite upper and lower walls of the peripheral wall portion 43 or the restricting projection 48 may be provided on any one or each one of the walls.

The locking edges 21 are provided on the opposite lateral edges forming the opposite sides of the escaping groove 19 in the above embodiment. However, they may be formed in the inner wall of the receptacle 14 to have a dovetail-shaped opening narrowed toward the inside.

The moving plate 40 has the projections 48A and the receptacle 14 has the locking edges 21 engageable with the projections 48A in the above-described embodiment. However, the moving plate 40 may be provided with locking edges and the receptacle 14 may be provided with projections engageable with the locking edge portions according to the present invention.

Although the restricting projections 48 have inclined surfaces engageable with the locking edge portions 21 in the above embodiment. However, they extend in parallel with the outer surfaces of the walls 43A.

Although the restricting projection 48 has two projections 48A in the above embodiment, it may have a single projection 48A.

The two projections 48A are arranged to be asymmetric with respect to the axis C in the above embodiment. However, they may be arranged to be symmetric with respect to the axis C according to the present invention.

The two projections 48A are provided using the two side walls of the introducing groove 45 in the above embodiment. However, they may project from the outer surface of the wall 43A independently of the introducing groove 45.

What is claimed is:

1. A connector, comprising:

a male connector with a forwardly open tubular receptacle and male terminal fittings accommodated in the male housing;

a moving plate inserted in the receptacle in a mating direction with the male connector and including a plate-like plate main body with positioning holes for receiving and positioning the male terminal fittings, the moving plate being movable toward a back side of the receptacle from an initial position where leading ends of the male terminal fittings project through the positioning holes and beyond a front surface of the plate main body, at least one protection wall projecting forward from the plate main body and beyond the leading ends of the male terminal fittings for protecting the leading ends of the male terminal fittings projecting at the initial position; and a female connector configured to fit into the receptacle in the mating direction and having at least one recess for accommodating the protection wall when the male and female connectors are connected in the mating direction, wherein the moving plate has a peripheral wall portion projecting forward from or near a peripheral edge of the plate main body and at least one lateral end of the protection wall is connected to the peripheral wall portion, at least one cutout being formed in a front end of the protection wall.

2. The connector of claim 1, wherein the male connector has a frame and a plurality of auxiliary housings in the frame.

3. The connector of claim 2, wherein the protection wall is arranged between first and second groups of male terminal fittings in at least one of the auxiliary housings.

4. The connector of claim 1, wherein the protection wall has a front end that is thinned relative to a rear end thereof.

5. The connector of claim 1, wherein at least one reinforcing wall projects laterally from the protection wall, and at least one jig hole is formed at a position of the plate main body corresponding to the reinforcing wall.

6. A connector, comprising:

a male connector with a forwardly open tubular receptacle and male terminal fittings accommodated in the male housing, at least one engageable portion formed in the receptacle;

a female connector fit into the receptacle; and a moving plate in the receptacle and including a plate-like plate main body with positioning holes for receiving the male terminal fittings, the moving plate being movable toward a back side of the receptacle together with the female connector, a substantially tubular peripheral wall portion projecting from the plate main body and disposed substantially along an inner peripheral surface of the receptacle, at least one lock on an outer surface of the peripheral wall portion, the lock being engageable with the engageable portion in the receptacle for correcting the peripheral wall portion to a proper posture in the receptacle, wherein two introducing grooves are formed in the peripheral wall portion, and the two projections projecting from sides of each of the introducing grooves of plates of the peripheral wall having the introducing grooves.

7. The connector of claim 6, wherein the lock includes two oppositely directed projections arranged to substantially face the outer surface of the peripheral wall portion.

8. The connector of claim 7, wherein the two projections are asymmetric with respect to an axis passing between the two projections.

* * * * *